US009711104B2

(12) United States Patent
Gyouten et al.

(10) Patent No.: US 9,711,104 B2
(45) Date of Patent: Jul. 18, 2017

(54) DISPLAY DEVICE AND ELECTRICAL APPARATUS

(71) Applicant: Sharp Kabushiki Kaisha, Osaka-shi, Osaka (JP)

(72) Inventors: Seijirou Gyouten, Osaka (JP); Takahiro Yamaguchi, Osaka (JP); Etsuo Yamamoto, Osaka (JP); Yuhichiroh Murakami, Osaka (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 530 days.

(21) Appl. No.: 14/359,612

(22) PCT Filed: Nov. 30, 2012

(86) PCT No.: PCT/JP2012/081061

§ 371 (c)(1),
(2) Date: May 21, 2014

(87) PCT Pub. No.: WO2013/084813

PCT Pub. Date: Jun. 13, 2013

(65) Prior Publication Data

US 2014/0340383 A1 Nov. 20, 2014

(30) Foreign Application Priority Data

Dec. 7, 2011 (JP) ..... 2011-268387

(51) Int. Cl.
*G09G 3/36* (2006.01)

(52) U.S. Cl.
CPC ..... *G09G 3/3696* (2013.01); *G09G 3/36* (2013.01); *G09G 2310/0289* (2013.01)

(58) Field of Classification Search
CPC . G09G 3/36; G09G 3/3696; G09G 2310/0289
See application file for complete search history.

(56) References Cited

U.S. PATENT DOCUMENTS 4,639,890 A * 1/1987 Heilveil ..... G09G 5/391 345/559
2002/0140661 A1 10/2002 Miyajima et al.
(Continued)

FOREIGN PATENT DOCUMENTS

JP 2002-297110 A 10/2002
JP 2010-286738 A 12/2010
(Continued)

OTHER PUBLICATIONS

Official Communication issued in International Patent Application No. PCT/JP2012/081061, mailed on Mar. 5, 2013.

*Primary Examiner* — Latanya Bibbins
(74) *Attorney, Agent, or Firm* — Keating & Bennett, LLP

(57) ABSTRACT

A display device is provided which is capable of preventing a malfunction and carrying out a common reverse drive without increasing electric power consumption. The display driver (a) supplies a voltage of a common electrode, whose a polarity is determined in accordance with (i) an oscillation circuit output signal (OCOUT) which is transmitted via a first wire different from a second wire used during a serial transmission and (ii) a SCS signal and (b) controls a reverse timing of the polarity of the voltage of the common electrode in accordance with the oscillation circuit output signal (OCOUT) and the SCS signal.

5 Claims, 29 Drawing Sheets

(56) References Cited

U.S. PATENT DOCUMENTS

| | | | | |
|---|---|---|---|---|
| 2010/0295841 | A1* | 11/2010 | Matsuda ..... | G09G 3/3674<br>345/213 |
| 2010/0309173 | A1 | 12/2010 | Matsuda et al. | |

FOREIGN PATENT DOCUMENTS

| | | | |
|---|---|---|---|
| WO | 2009/128280 | A1 | 10/2009 |
| WO | 2009/128283 | A1 | 10/2009 |

* cited by examiner

DISPLAY DEVICE AND ELECTRICAL APPARATUS

TECHNICAL FIELD

The present invention relates to a timing signal for use in a display operation of a display device.

BACKGROUND ART

It has been known a display device which (i) includes a memory circuit in each pixel (hereinafter, referred to as a pixel memory) and (ii) is capable of displaying, by causing the pixel memory to store image data, a still image with low electric power consumption without necessity of image data being externally supplied consecutively (see, for example, Patent Literature 1). Note that, once image data is written into a pixel, it becomes no longer necessary (i) to charge or discharge a data signal line via which image data is supplied to the pixel and (ii) to externally transmit image data to a driver in the panel. As such, the breakdown of reduction in electric power consumption includes (i) a reduction in electric power consumed during the charge or discharge of the data signal line and (ii) a reduction in electric power consumed during the transmission of the image data.

An SRAM-type pixel memory and a DRAM-type pixel memory have been developed and employed as the pixel memory. According to the display device, since a pixel voltage is a digital signal, it becomes difficult for a crosstalk to occur. As such, the display device excels in display quality.

FIG. 25 is a view schematically illustrating a configuration of a display device disclosed in Patent Literature 1. FIG. 26 is a timing chart illustrating waveforms of respective signals supplied to the display device.

According to the display device, image data DR, DG, and DB are supplied to a display driver by a serial transmission while being included in serial data SI. A first flag D1, which indicates a polarity of a voltage of a common electrode (Vcom), is added to the serial data SI. The display driver extracts the first flag D1, in synchronization with a serial clock SCLK, from the serial data SI and then carries out display in accordance with the serial data SI. The display driver further supplies a voltage of a common electrode (Vcom) which has a polarity corresponding to the first flag D1 thus extracted.

With the configuration, a separate circuit for indicating a polarity of a common reverse is unnecessary. This makes it possible to generate, in a small-scale circuit, a timing signal for a common reverse.

CITATION LIST

Patent Literature

Patent Literature 1
International Publication No. WO2009/128280 A (Publication Date: Oct. 22, 2009)

SUMMARY OF INVENTION

Technical Problem

According to the configuration of Patent Literature 1, however, it is necessary that a CPU continues to issue instruction on a common reverse in accordance with a cycle of the common reverse (see FIG. 27). Accordingly, even in a case where a still image is displayed without the necessity of image data being supplied consecutively, it is necessary to periodically causing the CPU to operate so as to supply a signal. This causes a problem that electric power consumption is increased.

It is conceivable that, in order to address such a problem, a configuration is employed in which an instruction on a common reverse is carried out by use of an output of an oscillation circuit (see, for example, FIG. 28).

The configuration, however, may cause the following problem. Specifically, in a case where a timing of a common reverse overlaps a writing period in which image data is written into a display panel, a malfunction may occur due to an influence of power supply noise caused by the common reverse (see FIG. 29).

The present invention has been made in view of the problems, and an object of the present invention is to provide (i) a display device capable of preventing a malfunction and carrying out a common reverse drive without increasing electric power consumption and (ii) an electronic device including the display device.

Solution to Problem

In order to attain the object, a display device of the present invention is an active matrix type display device including: a display driver to which image data is supplied, by a serial transmission, while the image data is being included in serial data, the display driver (a) carrying out display in accordance with the serial data, (b) supplying a voltage, of a common electrode, whose polarity is determined in accordance with (i) a timing signal, having a certain cycle, which is transmitted via a first wire which is different from a second wire used during the serial transmission and (ii) at least one reverse timing signal which indicates a time period in which a reverse of a polarity of a voltage of a common electrode is prohibited or permitted, and (c) controlling a reverse timing of the polarity of the voltage of the common electrode in accordance with the timing signal having the certain cycle and the reverse timing signal.

Advantageous Effects of Invention

As described above, a display device of the present invention includes: the display driver (a) carrying out display in accordance with the serial data, (b) supplying a voltage, of a common electrode, whose polarity is determined in accordance with (i) a timing signal, having a certain cycle, which is transmitted via a first wire which is different from a second wire used during the serial transmission and (ii) at least one reverse timing signal which indicates a time period in which a reverse of a polarity of a voltage of a common electrode is prohibited or permitted, and (c) controlling a reverse timing of the polarity of the voltage of the common electrode in accordance with the timing signal having the certain cycle and the reverse timing signal. This makes it possible to provide (i) a display device capable of preventing a malfunction and carrying out a common reverse drive without increasing electric power consumption and (ii) an electronic device including the display device.

DESCRIPTION OF EMBODIMENTS

The following description will discuss an embodiment of the present invention with reference to the drawings.

Figure 3:
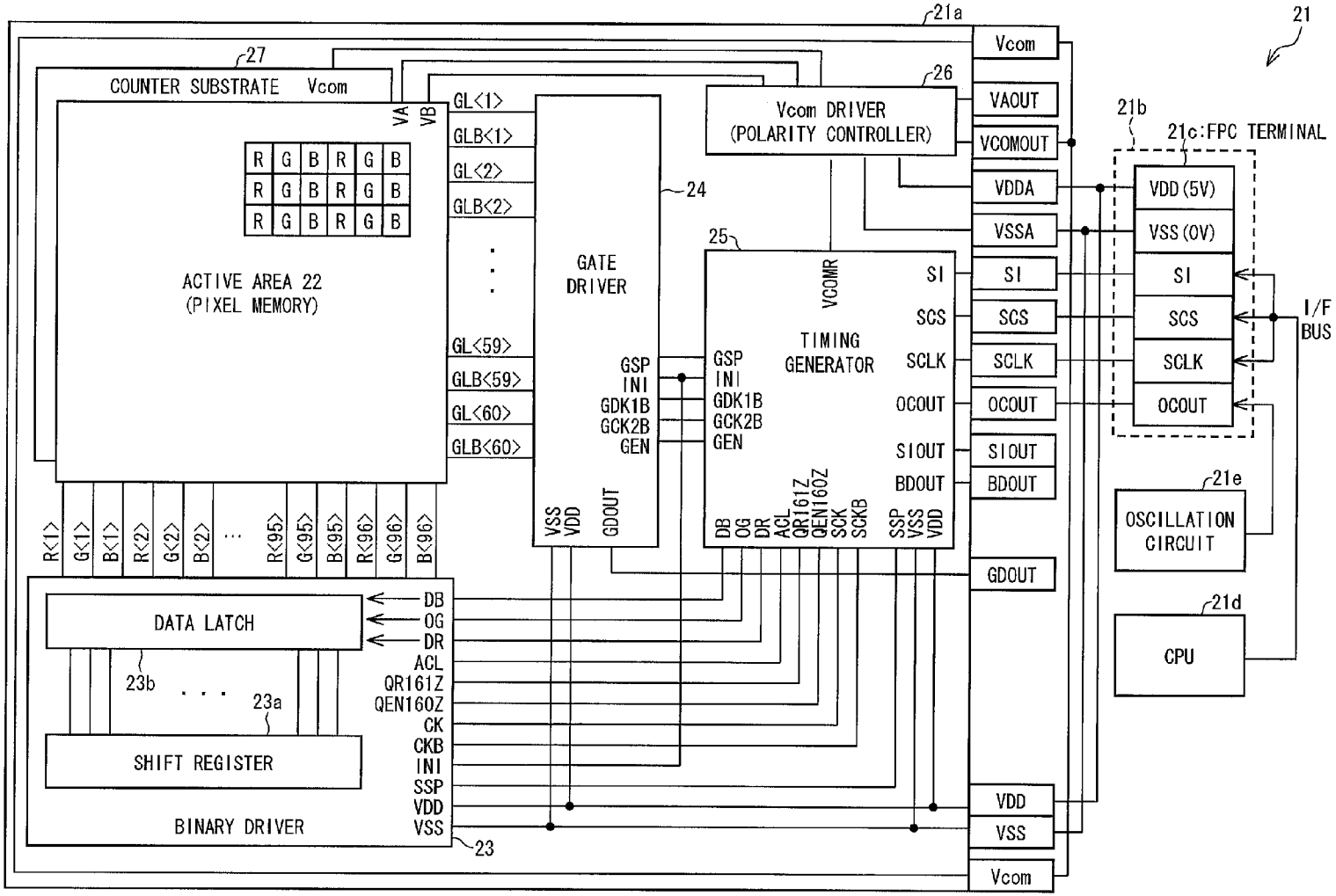
FIG. 3 is a block diagram illustrating an entire configuration of the liquid crystal display device of the present embodiment.

FIG. 3 illustrates an entire configuration of a liquid crystal display device (display device) 21 of the present embodiment.

Examples of the liquid crystal display device 21 encompass a display device included in an electronic device such as a mobile phone, a watch having a GPS function, or a microwave oven. The liquid crystal display device 21 includes a display panel 21*a* and a flexible print substrate (FPC) 21*b*. The display panel 21*a* is configured such that various types of circuits are monolithically integrated. The flexible print substrate 21*b* receives serial data SI, a serial chip select signal SCS, and a serial clock SCLK via a serial transmission. The serial transmission is carried out via a three-line serial interface bus (I/F BUS) while being controlled by a CPU 21*d* such as an application processor. The flexible print substrate 21*b* supplies the signals SI, SCS, and SCLK to the display panel 21*a* via an FPC terminal 21*c*. Note that the serial transmission can be alternatively controlled by another control means such as a microcontroller. The flexible print substrate 21*b* supplies a power supply VDD of 5V and a power supply VSS of 0V, each of which power supply is externally supplied, to the display panel 21*a* via the FPC terminal 21*c*. The flexible print substrate 21*b* further supplies a signal, supplied from an oscillation circuit 21*e* (an oscillation circuit output signal OCOUT), to the display panel 21*a* via the FPC terminal 21*c*. Note that the oscillation circuit 21*e* can be alternatively provided in the display panel 21*a*.

The display panel 21*a* includes an active area 22, a binary driver (data signal line driver) 23, a gate driver (scanning signal line driver) 24, a timing generator 25, and a Vcom driver 26. The display driver is made up of the binary driver 23, the gate driver 24, the timing generator 25, and the Vcom driver 26.

The active area 22 is a region in which pixels of R, G, and B are provided in a matrix manner, for example, 96×RGB×60. Each of the pixels includes a corresponding pixel memory. The binary driver 23 (*i*) is a circuit which supplies image data to the active area 22 via source lines and (ii) includes a shift register 23*a* and a data latch 23*b*. The gate driver 24 selects a gate line of a pixel to which image data of the active area 22 is to be supplied. The timing generator 25 generates, in accordance with a signal supplied from the flexible print substrate 21*b*, signals which are to be supplied to the binary driver 23, the gate driver 24, and the Vcom driver 26.

Figure 4:
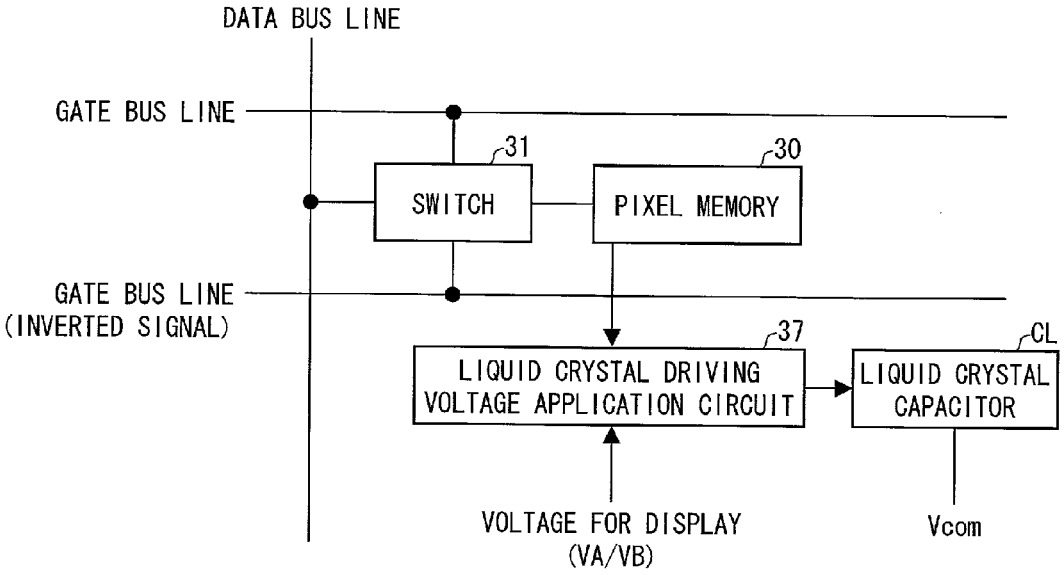
FIG. 4 is a block diagram illustrating a configuration of each pixel PIX provided in an active area illustrated in FIG. 3.
Figure 5:
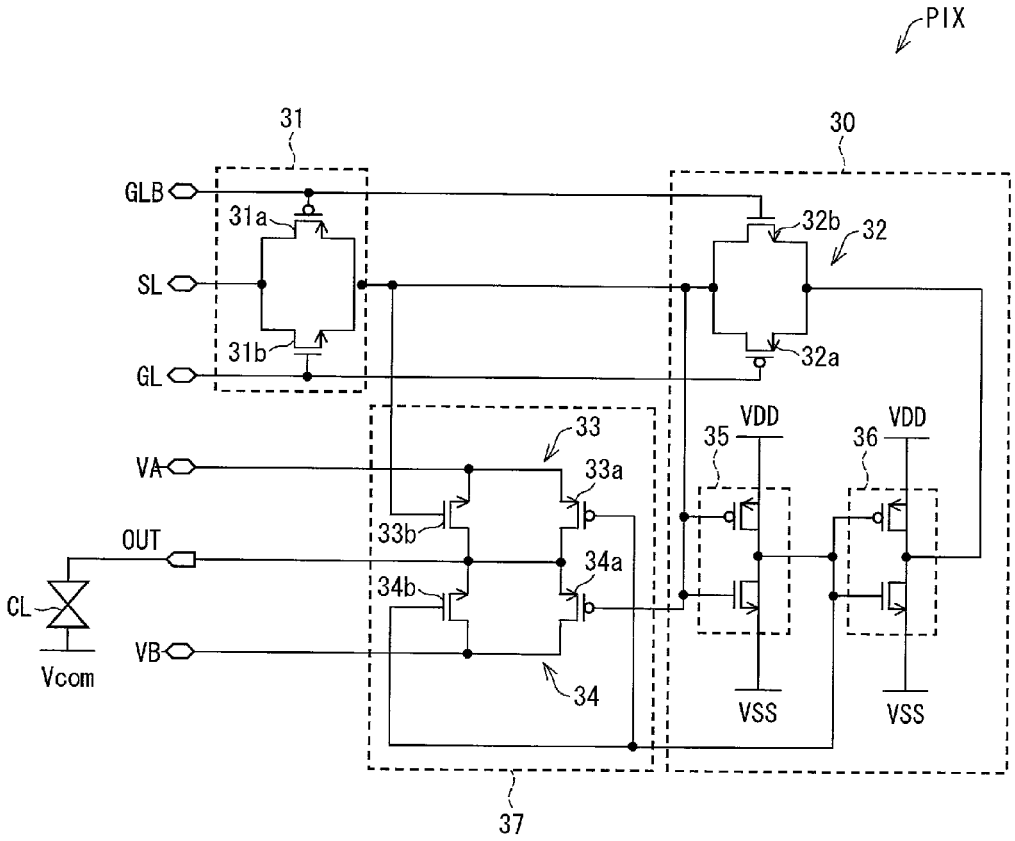
FIG. 5 is a circuit diagram illustrating a configuration of each pixel PIX.

FIG. 4 is a block diagram illustrating a configuration of each pixel PIX provided in an active area 22. FIG. 5 is a circuit diagram illustrating a configuration of each pixel PIX.

The pixel PIX includes a liquid crystal capacitor CL, a pixel memory 30, an analog switch 31, and a liquid crystal driving voltage application circuit 37. The pixel memory 30 includes an analog switch 32 and inverters 35 and 36. The liquid crystal driving voltage application circuit 37 includes analog switches 33 and 34.

The liquid crystal capacitor CL is achieved by a pixel electrode voltage output OUT, a common output Vcom which is a voltage of a common electrode, and a light dispersed liquid crystal therebetween. Examples of the light dispersed liquid crystal encompass a Polymer Dispersed Liquid Crystal (PDLC) and a Polymer Network Liquid Crystal (PNLC). Note that a liquid crystal material other than the light dispersed liquid crystal can be alternatively employed. The analog switches 31 through 34 and the inverters 35 and 36 are each constituted by a CMOS circuit.

The analog switch 31 (*i*) is provided between the source line output SL and the pixel memory 30 and (ii) includes (a) a PMOS transistor 31*a* whose gate is connected to a gate line reverse output GLB and (b) an NMOS transistor 31*b* whose gate is connected to a gate line output GL. According to the pixel memory 30, the analog switch 32 (*i*) is provided between an input of the inverter 35 and an output of the inverter 36 and (ii) includes (a) a PMOS transistor 32*a* whose gate is connected to the gate line output GL and (b) an NMOS transistor 32*b* whose gate is connected to the gate line reverse output GLB. The input of the inverter 35 is connected to a connection terminal on a side opposite to a side of the source line output SL of the analog switch 31. An output of the inverter 35 is connected to an input of the inverter 36. The inverters 35 and 36 each use the power supply VDD as a high-side power supply and use the power supply VSS as a low-side power supply.

The analog switch 33 (*i*) is provided between a black polarity output VA and a pixel electrode voltage output OUT and (ii) includes (a) a PMOS transistor 33*a* whose gate is connected to the output of the inverter 35 and (b) an NMOS transistor 33*b* whose gate is connected to the input of the inverter 35. The analog switch 34 (*i*) is provided between a white polarity output VB and the pixel electrode voltage output OUT and (ii) includes (a) a PMOS transistor 34*a* whose gate is connected to the input of the inverter 35 and (b) an NMOS transistor 34*b* whose gate is connected to the output of the inverter 35.

Figure 6:
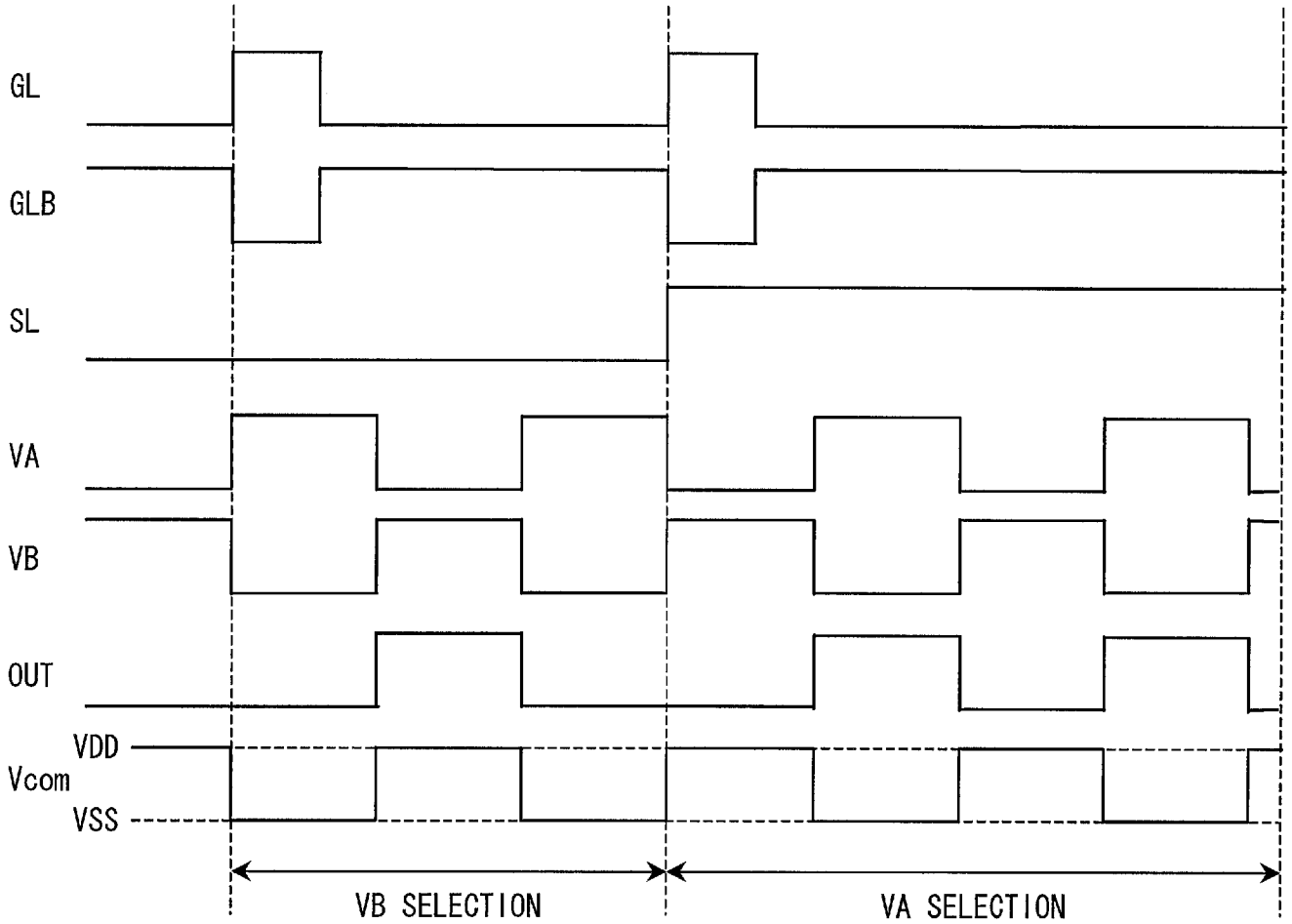
FIG. 6 is a timing chart illustrating output waveforms of a Vcom driver.

FIG. 6 illustrates waveforms of the common output Vcom, the black polarity output VA, and the white polarity output VB. These signals are generated by the Vcom driver 26. The common output Vcom has a pulse waveform of 5 Vp-p whose polarity alternates, for each frame, between positive polarity and negative polarity. Note that a cycle, on which the polarity alternates, can be arbitrarily set, for example, for every given horizontal period(s). The black polarity output VA has a pulse waveform of 5 Vp-p whose phase is reversed with respect to the common output Vcom. The white polarity output VB (in a case of a normally white) has a pulse waveform of 5 Vp-p whose phase is identical with that of the common output Vcom.

According to FIG. 5, in a case where a high level (5V) is outputted, as a source line output SL, from the binary driver 23, an analog switch 31 of a pixel PIX which is selected by a gate line output GL of high level (5V) and a gate line reverse output GLB of low level (0V) is turned on. This causes the analog switch 33 to be turned on and the analog switch 34 to be turned off. Accordingly, a black polarity output VA is outputted via a pixel electrode voltage output OUT. A voltage of 5V, equal to a difference between the black polarity output VA and the common output Vcom, is applied across the liquid crystal capacitor CL. This causes the pixel PIX to be in a black display state.

Thereafter, in a case where the gate line output GL and the gate line reverse output GLB become low level (0V) and high level (5V), respectively, the analog switch 31 is turned off and the analog switch 32 is turned on. This causes the pixel memory 30 to store the high level. The stored data is retained until the identical pixel PIX is selected next so that the analog switch 31 is turned on.

According to FIG. 5, in contrast, in a case where a low level (0V) is outputted, as a source line output SL, from the binary driver 23, an analog switch 31 of a pixel PIX which is selected by a gate line output GL of high level (5V) and a gate line reverse output GLB of low level (0V) is turned on. This causes the analog switch 33 to be turned off and the analog switch 34 to be turned on. Accordingly, a white polarity output VB is outputted via a pixel electrode voltage output OUT. A voltage of 0V, equal to a difference between the white polarity output VB and the common output Vcom, is applied across the liquid crystal capacitor CL. This causes the pixel PIX to be in a white display state.

Thereafter, in a case where the gate line output GL and the gate line reverse output GLB become low level (0V) and high level (5V), respectively, the analog switch 31 is turned off and the analog switch 32 is turned on. This causes the pixel memory 30 to store the low level. The stored data is retained until the identical pixel PIX is selected next so that the analog switch 31 is turned on.

Figure 1:
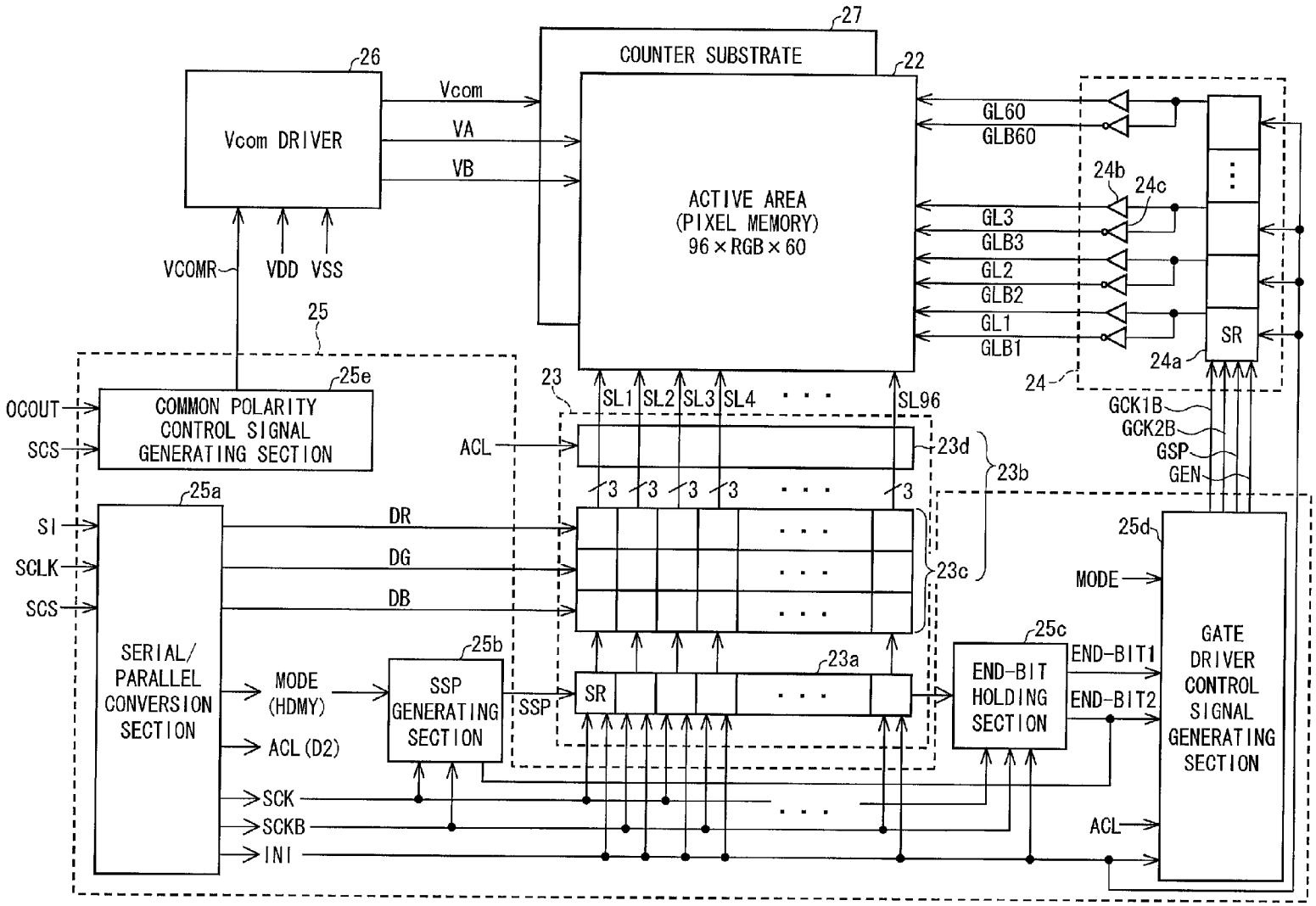
FIG. 1 is a block diagram illustrating connection relations of a main part of the liquid crystal display device of the present embodiment.

FIG. 1 illustrates connection relations of the timing generator 25, the binary driver 23, the gate driver 24, and the Vcom driver 26.

The timing generator 25 includes a serial/parallel conversion section 25*a*, a source start pulse generating section 25*b*, an END-BIT holding section 25*c*, a gate driver control signal generating section 25*d*, and a common polarity control signal generating section 25*e*.

In response to serial data SI, a serial clock SCLK, and a serial chip select signal SCS each of which is externally supplied, the timing generator 25 generates (i) a mode signal MODE, (ii) an all-clear signal ACL, (iii) source clocks SCK and SCKB (timing signals serving as clock signals in synchronization with which a shift register of a data signal line driver is operated), (iv) a source start pulse SSP (a timing signal for a horizontal period), (v) gate clocks GCK1B and GCK2B (timing signals to be supplied to a shift register of a gate signal line driver), (vi) a gate start pulse GSP, (vii) a gate enable signal GEN (a timing signal for controlling a GL line selection period of the gate signal line driver), and (viii) an initial signal INI. The timing generator 25 further generates a common polarity control signal VCOMR in accordance with (i) an oscillation circuit output signal OCOUT which is supplied from the oscillation circuit 21*e* and (ii) a serial chip select signal SCS.

A source start pulse SSP, source clocks SCK and SCKB, and an initial signal INI are supplied from the timing generator 25 to the binary driver 23. Gate clocks GCK1B and GCK2B, a gate start pulse GSP, a gate enable signal GEN, and an initial signal INI are supplied from the timing generator 25 to the gate driver 24. A common polarity control signal VCOMR is supplied from the timing generator 25 to the Vcom driver 26. Note that the source clocks SCK and SCKB (i) are used to generate a source start pulse SSP for each horizontal period (later described) and (ii) each serve as a clock signal in synchronization with which the shift register 23*a* of the binary driver 23 is operated.

Figure 2:
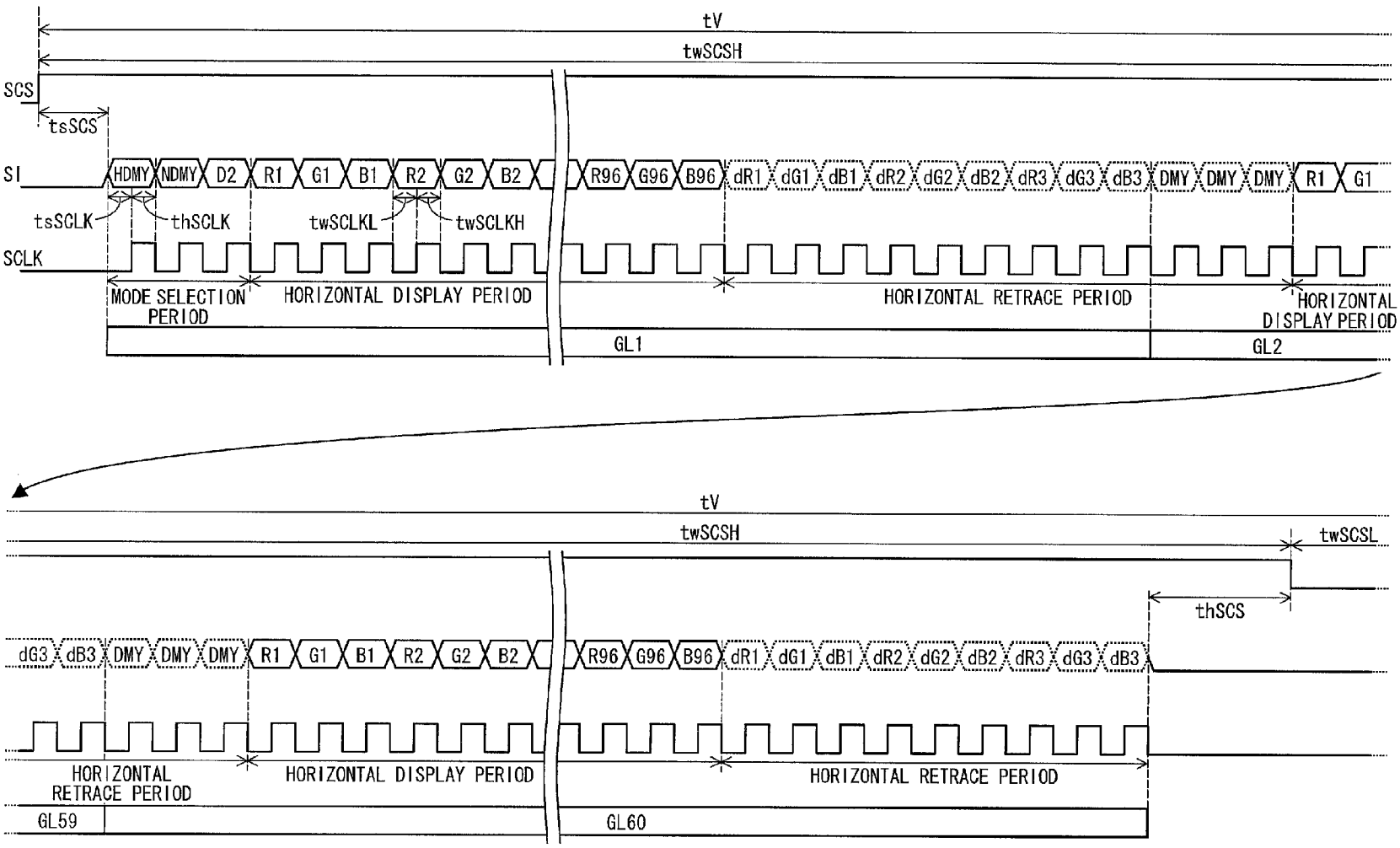
FIG. 2 is a timing chart illustrating waveforms of signals for a serial transmission in a data update mode.

Serial data SI, a serial clock SCLK, and a serial chip select signal SCS are supplied from the flexible print substrate 21*b* to the serial/parallel conversion section 25*a*. As described above, since the serial interface bus I/F BUS is of three-line type, the serial data SI, the serial clock SCLK, and the serial chip select signal SCS are transmitted via respective different wires. These signals are illustrated in FIG. 2.

The serial data SI is a signal in which a flag D2 and dummy data HDMY and NDMY are added, during a mode selection period provided at the head of each frame, to binary RGB digital image data arranged in serial. According to the dummy data, the NDMY can be either high or low. Note, however, that the HDMY always needs to be fixed to high.

In a data update mode in which image data is written into the pixel memory 30 (see FIG. 2), image data, in which RGB data corresponding to one (1) horizontal display period is arranged in a time series manner, is arranged in an order of horizontal display period. Moreover, dummy data dR1, dG1, dB1, . . . are provided during a horizontal retrace period between adjacent horizontal display periods. Three dummy data DMY, DMY, and DMY are provided during periods corresponding to respective headmost horizontal display periods HDMY, NDMY, and D2. Note that the dummy data can be either high or low.

The flag D2 is an all-clear flag. In a case where the flag D2 is high, the flag D2 causes the timing generator 25 to write white display data into each of all pixels PIX in a frame. On the other hand, in a case where the flag D2 is low, the flag D2 causes the timing generator 25 to write, into each of all pixels PIX in the frame, image data to be supplied. In this way, in a case where the flag D2 is high, the flag D2 causes display of all the pixels PIX to be initialized. Note that the flag D2 is normally low.

The serial clock SCLK is a synchronization clock for extracting each data including a flag of the serial data SI. The following description will discuss examples of a rising timing and a falling timing of the serial clock SCLK. As to the dummy data HDMY or the flag D2, the serial clock SCLK rises at a time point when time tsSCLK has elapsed after the dummy data or the flag respectively starts to be transmitted. As to each of the image data R, G, and B, the serial clock SCLK rises at a corresponding time point when time twSCLKL has elapsed after corresponding image data starts to be transmitted. tsSCLK is equal to twSCLKL and is therefore equal to a low period of the serial clock SCLK. As to the dummy data HDMY or the flag D2, the serial clock SCLK falls at a time point when (i) time thSCLK has elapsed after the serial clock SCLK rises and (ii) the dummy data or the flag respectively stops being transmitted (i.e., a time point when the dummy data or the flag switches to next dummy data or a next flag). As to each of the image data R, G, and B, the serial clock SCLK falls at a corresponding time point when (i) time twSCLKH has elapsed after the serial clock SCLK rises and (ii) corresponding image data stops being transmitted (i.e., a time point when the dummy data or the flag switches to next dummy data or a next flag). thSCLK is equal to twSCLKH and is therefore equal to a high period of the serial clock SCLK. Note here that a duty ratio of the serial clock SCLK is 50%.

The serial chip select signal SCS is a signal which becomes high only during a period twSCSH, when serial data SI and a serial clock SCLK are transmitted from the CPU to the timing generator 25 via the serial interface bus I/F BUS. The serial chip select signal SCS becomes high at a time point which is a time period tsSCS earlier than a time point when the serial data SI starts to be transmitted in a frame in which the serial data SI and the serial clock SCLK are transmitted, whereas the serial chip select signal SCS becomes low at a timing point which is a time period thSCS later than a time point when the serial data SI stops being transmitted.

The image data, which has been written into the pixel memory 30 in the data update mode (see FIG. 2), keeps being retained until the data is updated next.

From the serial data SI, the serial clock SCLK, and the serial chip select signal SCS which are thus supplied, the serial/parallel conversion section 25*a* extracts the flag D2, the dummy data HDMY, data DR of R, data DG of G, and data DB of B. The other circuits generate signals in accordance with (i) the dummy data HDMY serving as a mode signal MODE and (ii) the flag D2 serving as an all-clear signal ACL. The data DR, DG, and DB are supplied to the data latch 23*b* of the binary driver 23.

The serial/parallel conversion section 25*a* further generates source clocks SCK and SCKB and an initial signal INI in accordance with the serial data SI, the serial clock SCLK, and the serial chip select signal SCS. The source clocks SCK and SCKB are supplied to the binary driver 23. The other circuits generate signals in accordance with the initial signal INI.

The source start pulse generating section 25*b* (i) generates a source start pulse SSP for a first horizontal display period in accordance with the mode signal MODE and the source clocks SCK and SCKB each of which is supplied from the serial/parallel conversion section 25*b* and then (ii) supplies the source start pulse SSP thus generated to the shift register 23*a* of the binary driver 23. The source start pulse SSP for the first horizontal display period can be generated in synchronization with a rising edge of the mode signal MODE. Source start pulses SSP for subsequent horizontal display periods of a second horizontal display period can be generated in accordance with a second end bit END-BIT2 generated by the END-BIT holding section 25*c* (later described).

The END-BIT holding section 25*c* (i) generates a first end bit END-BIT1 and a second end bit END-BIT2 in accordance with an output of a final stage of the shift register 23*a* of the binary driver 23 and then (ii) supplies the first end bit END-BIT1 and the second end bit END-BIT2 thus generated to the gate driver control signal generating section 25*d*. The first end bit END-BIT1 is obtained by a dummy shift register which further shifts, by a given stage(s), the output of the final stage of the shift register 23*a*. The second end bit END-BIT2 is obtained by the dummy shift register which further shifts, by only one stage, the first end bit END-BIT1.

The gate driver control signal generating section 25*d* (i) generates gate clocks GCK1B and GCK2B, a gate start pulse GSP, and a gate enable signal GEN in accordance with the first end bit END-BIT1, the second end bit END-BIT2, the mode signal MODE, and the all-clear signal ACL and then (ii) supplies, to the gate driver 24, the gate clocks GCK1B and GCK2B, the gate start pulse GSP, and the gate enable signal GEN thus generated.

The common polarity control signal generating section 25*e* (i) generates, in accordance with the serial chip select signal SCS and an oscillation circuit output signal OCOUT which is supplied from the oscillation circuit 21*e*, a common polarity control signal VCOMR which indicates a polarity of a voltage of a common electrode and then (ii) supplies, to the Vcom driver 26, the common polarity control signal VCOMR thus generated. A configuration of the common polarity control signal generating section 25*e* will be specifically described later.

The shift register 23*a* of the binary driver 23 generates an output of each stage SR, in accordance with (i) a source start pulse SSP supplied from the source start pulse generating section 25*b* of the timing generator 25 and (ii) an initial signal INI and source clocks SCK and SCKB each of which is supplied from the serial/parallel conversion section 25*a* of the timing generator 25. The data latch 23*b* includes a first latch circuit 23*c* and an all-clear circuit 23*d*. The first latch circuit 23*c* (i) sequentially latches, at a timing when the each stage SR of the shift register 23*a* outputs, data DR, DG, and DB each of which is supplied from the serial/parallel conversion section 25*a* of the timing generator 25 and then (ii) supplies each of the data DR, DG, and DB thus latched to a corresponding one of source lines SL (SL1 through SL96 for each of R, G, and B). The all-clear circuit 23*d* supplies white display data to all source lines SL, in a case where (i) the flag D2 of the serial data SI is high and (ii) an active all-clear signal ACL is supplied from the serial/parallel conversion section 25*a* of the timing generator 25.

The gate driver 24 includes a plurality of shift registers 24*a* and a plurality of buffers 24*b* and a plurality of reverse buffers 24*c*. The shift register 24*a* generates an output of the each stage SR, in accordance with (i) gate clocks GCK1B and GCK2B, a gate start pulse GSP, and a gate enable signal GEN each of which is supplied from the gate driver control signal generating section 25*d* of the timing generator 25 and (ii) an initial signal INI supplied from the serial/parallel conversion section 25*a*. The buffers 24*b* and the reverse buffers 24*c* are provided, in pairs, for respective pixel rows. Specifically, inputs of each pair of buffers 24*b* and 24*c* are connected to an output of an SR of a corresponding stage of the shift register 24*a*. An output of the buffer 24*b* and an output of the buffer 24*c* in the each pair are connected to a corresponding one of gate lines GL (GL1 through GL60) and a corresponding one of gate lines GLB (GLB1 through GLB60), respectively.

The Vcom driver 26 generates a common output Vcom, a black polarity output VA, and a white polarity output VB, in accordance with (i) a common polarity control signal VCOMR supplied from the common polarity control signal generating section 25*e* of the timing generator 25 and (ii) power supplies VDD and VSS. The Vcom driver 26 then supplies the black polarity output VA and the white polarity output VB to the active area 22, and the Vcom driver 26 supplies the common output Vcom to a counter electrode of the counter substrate 27.

Figure 7:
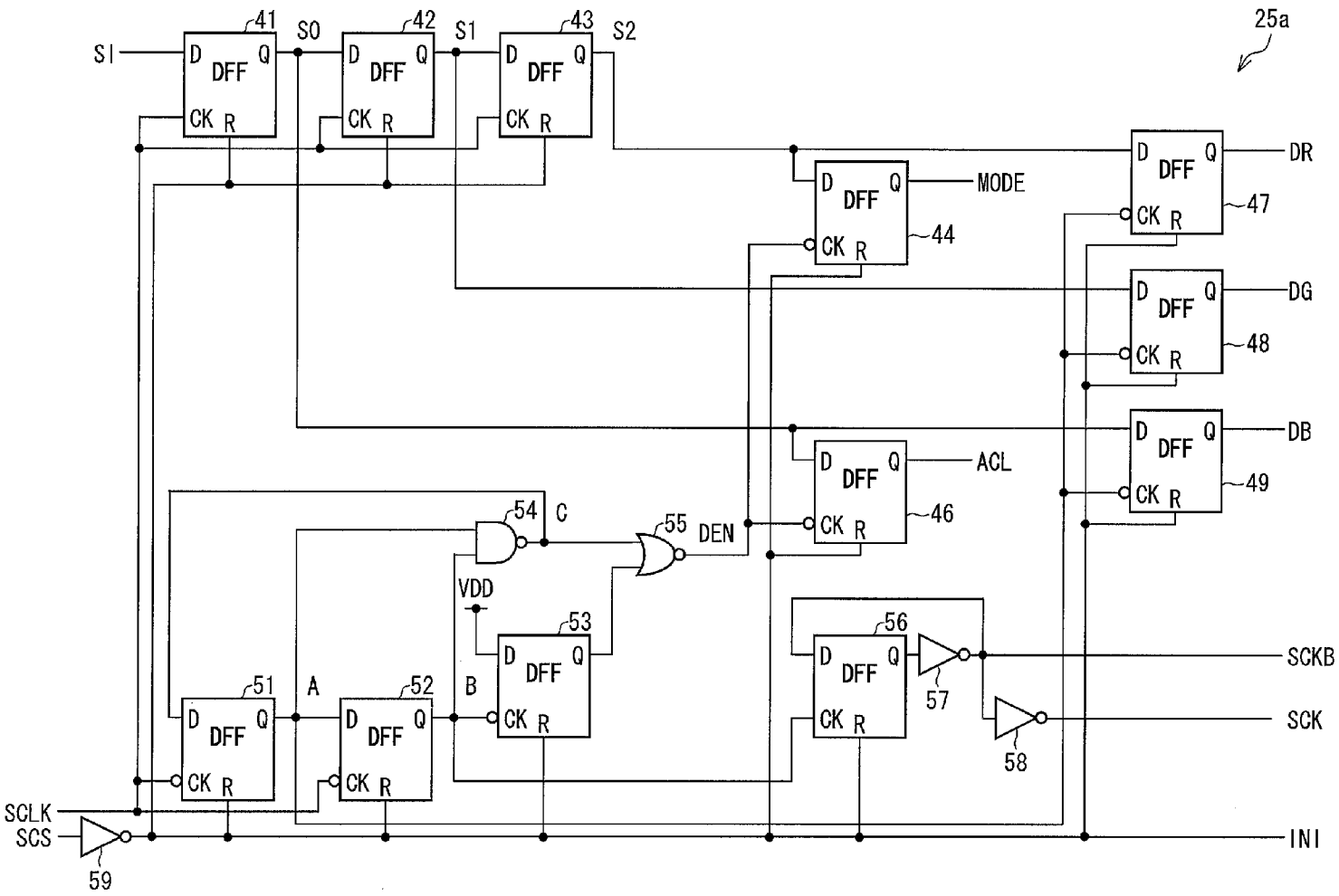
FIG. 7 is a circuit diagram illustrating a configuration of a serial/parallel conversion section.

FIG. 7 specifically illustrates an example configuration of a serial/parallel conversion section 25*a*.

The serial data SI sequentially passes through D flipflops 41, 42, and 43 which are connected in cascade. Upon receipt of an output S2 of the D flipflop 43 of a third stage, a D flipflop 44 generates a mode signal MODE. Upon receipt of an output S0 of the D flipflop 41 of a first stage, a D flipflop 46 generates an all-clear signal ACL. In a case where pieces of image data are arranged in time series in an order of R, G, and B, (i) a D flipflop 47 generates data DR upon receipt of an output S2, (ii) a D flipflop 48 generates data DG upon receipt of an output S1, and (iii) a D flipflop 49 generates data DB upon receipt of an output S0.

Note here that (i) a serial clock SCLK is supplied to a high active clock terminal CK of each of the D flipflops 41, 42, and 43 and (ii) an output DEN of a two-input NOR gate 55 is supplied to a low active clock terminal CK of each of the flipflops 44 and 46. An output A of the D flipflop 51 is supplied to a low active clock terminal CK of each of the D flipflops 47, 48, and 49.

An input of the NOR gate 55 is connected to an output of a D flipflop 53, and the other input of the NOR gate 55 is connected to an output C of a two-input NAND gate 54. An input of the D flipflop 53 is connected to a power supply VDD, and a low active clock terminal CK is connected to an output B of a D flipflop 52. An input of the NAND gate 54 is connected to an output B, and the other input of the NAND gate 54 is connected to an output A. An input of a D flipflop 51 is connected to an output C. An input of the D flipflop 52 is connected to an output A. A serial clock SCLK is supplied to a low active clock terminal CK of each of the D flipflops 51 and 52.

A source clock SCKB is obtained by subjecting an output of a D flipflop 56 to an inverter 57. A source clock SCK is obtained by subjecting an output of the inverter 57 to an inverter 58. An input of the D flipflop 56 is connected to an output of the inverter 57, and a high active clock terminal CK is connected to an output B.

According to each of the D flipflops, a positive edge trigger is carried out via the high active clock terminal CK, whereas a negative edge trigger is carried out via the low active clock terminal CK.

A serial chip select signal SCS is supplied to a reset terminal R of each of the D flipflops 41 through 53 and 56 via an inverter 59. An initial signal INI is obtained by the inverter 59 inverting a serial chip select signal SCS.

Figure 12:
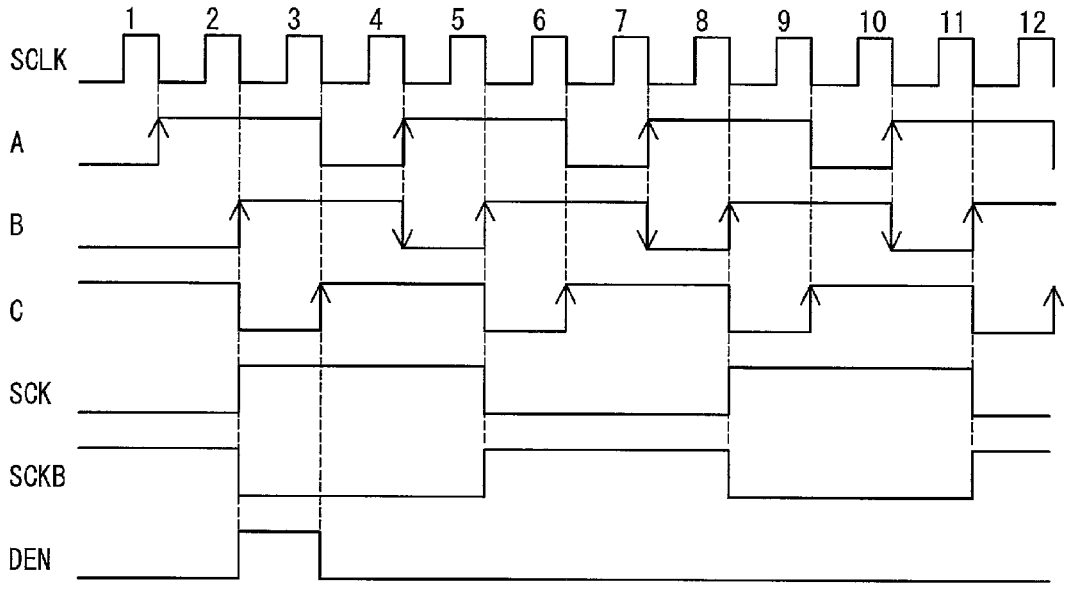
FIG. 12 is a timing chart illustrating signal waveforms of the serial/parallel conversion section.

FIG. 12 is a timing chart illustrating waveforms of the serial clock SCLK, the outputs A, B, and C, the source clocks SCK and SCKB, and the output DEN.

Figure 8:
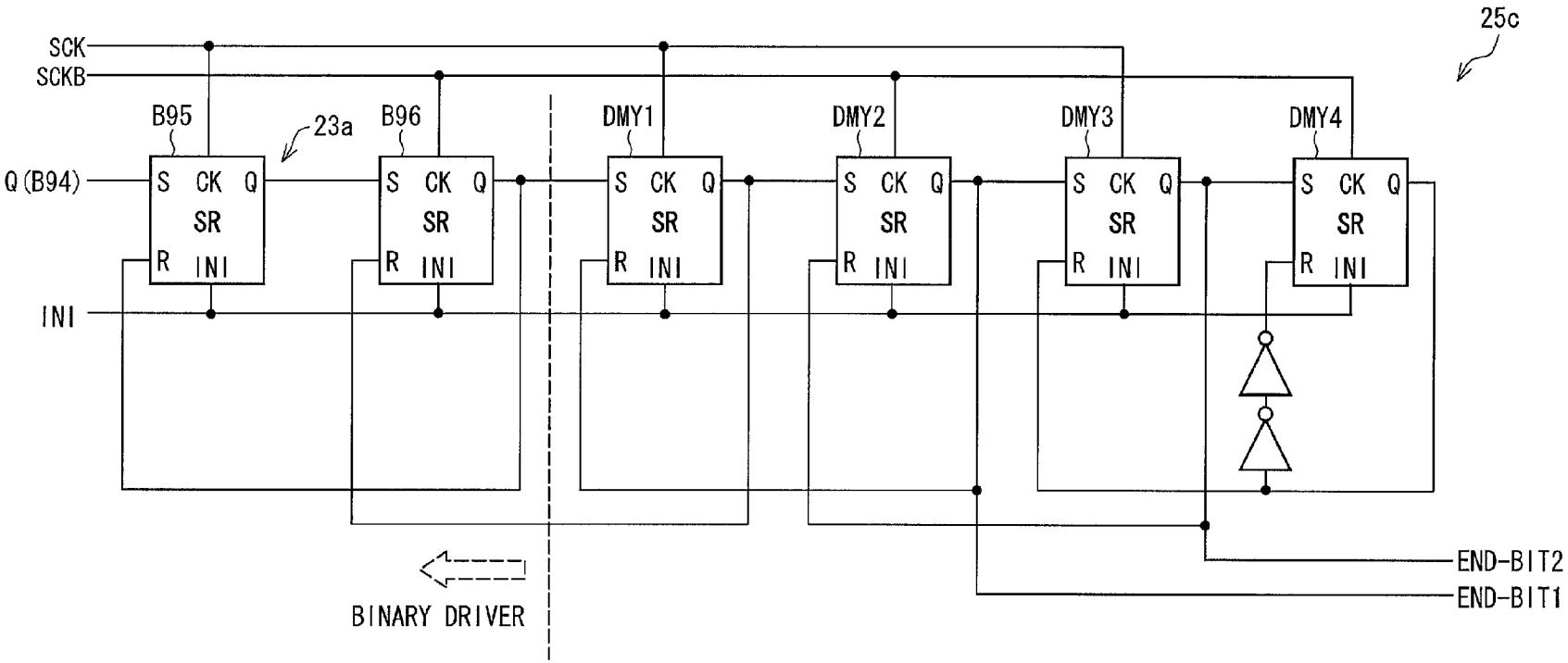
FIG. 8 is a circuit diagram illustrating a configuration of an END-BIT holding section.

FIG. 8 specifically illustrates an example configuration of an END-BIT holding section 25*c*.

The shift register 23*a* of the binary driver 23 is configured such that unit circuits SR are connected in cascade. The unit circuits SR are each configured to include a set/reset flipflop circuit and a clock control circuit. Source clocks SCK and SCKB are alternately supplied to a clock terminal CK of each of the unit circuits SR for each stage. An initial signal INI is supplied to an INI terminal of each of the unit circuits SR.

FIG. 8 illustrates unit circuits SR (B95 and B96) of final two stages (a 95th stage and a 96th stage). An output Q of a unit circuit SR (B94) of a stage (a 94 stage), which is followed by a unit circuit SR (B95), is supplied to a set input terminal S of the unit circuit SR (B95) of the 95th stage.

According to the END-BIT holding section 25*c*, dummy unit circuits SR (DMY1, DMY2, DMY3, and DMY4) are sequentially connected, in an identical cascade connection, so as to follow a final stage of the shift register 23*a*. Note that the unit circuits SR (DMY1, DMY2, DMY3, and DMY4) have configurations identical to those of the unit circuits SR of the binary driver 23. Note also that an output Q of a following one of any adjacent two of the unit circuits SR (DMY1, DMY2, DMY3, and DMY4) is supplied, as a reset signal, to a reset input terminal R of a followed one of the any adjacent two of the unit circuits SR. Note, however, that, as to the unit circuit SR (DMY4) of a final stage, its output Q is supplied, as a reset signal, to its reset input terminal, via two inverters by which the output signal Q is delayed.

With the configuration, an output Q of the unit circuit SR (DMY2) and an output Q of the unit circuit SR (DMY3) are obtained as a first end bit END-BIT1 and a second end bit END-BIT2, respectively.

Figure 9:
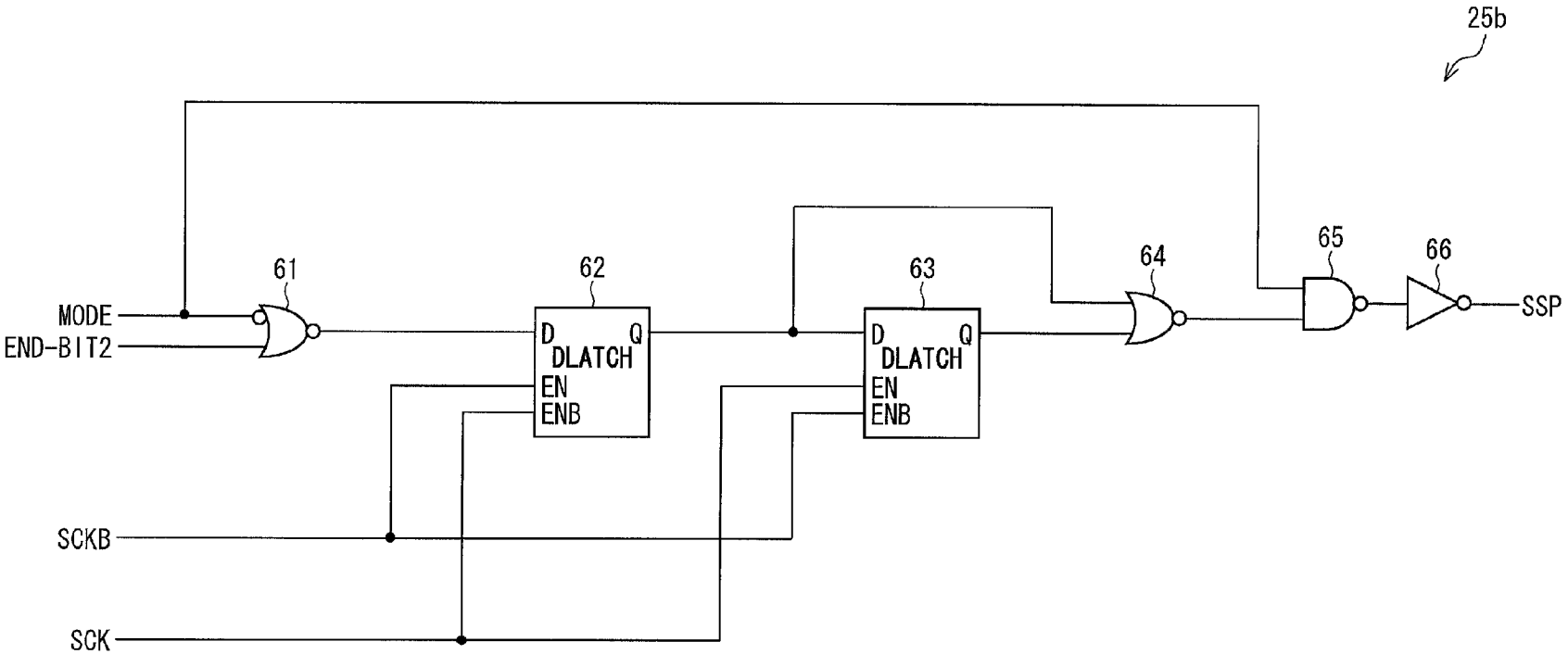
FIG. 9 is a circuit diagram illustrating a configuration of a source start pulse generating section.

FIG. 9 specifically illustrates an example configuration of a source start pulse generating section 25*b*.

A mode signal MODE is supplied to a low active input of a two-input NOR gate 61, and a second end bit END-BIT2 is supplied to the other (high active input) of the two-input NOR gate 61. An output of the NOR gate 61 is supplied to a D latch 62, and an output of the D latch 62 is supplied to a D latch 63. A source clock SCKB, which has been generated by the serial/parallel conversion section 25*a*, is supplied to an enable terminal EN of the D latch 62 and an enable terminal ENB of the D latch 63. A source clock SCK, which is generated by the serial/parallel conversion section 25*a*, is supplied to an enable terminal ENB of the D latch 62 and an enable terminal EN of the D latch 63. An output of the D latch 62 and an output of the D latch 63 are supplied to a two-input NOR gate 64. An output of the NOR gate 64 and a mode signal MODE are supplied to a two-input NAND gate 65. An output of the NAND gate 65 is supplied to an inverter 66 so that an output of the inverter 66 serves as a source start pulse SSP.

Figure 10:
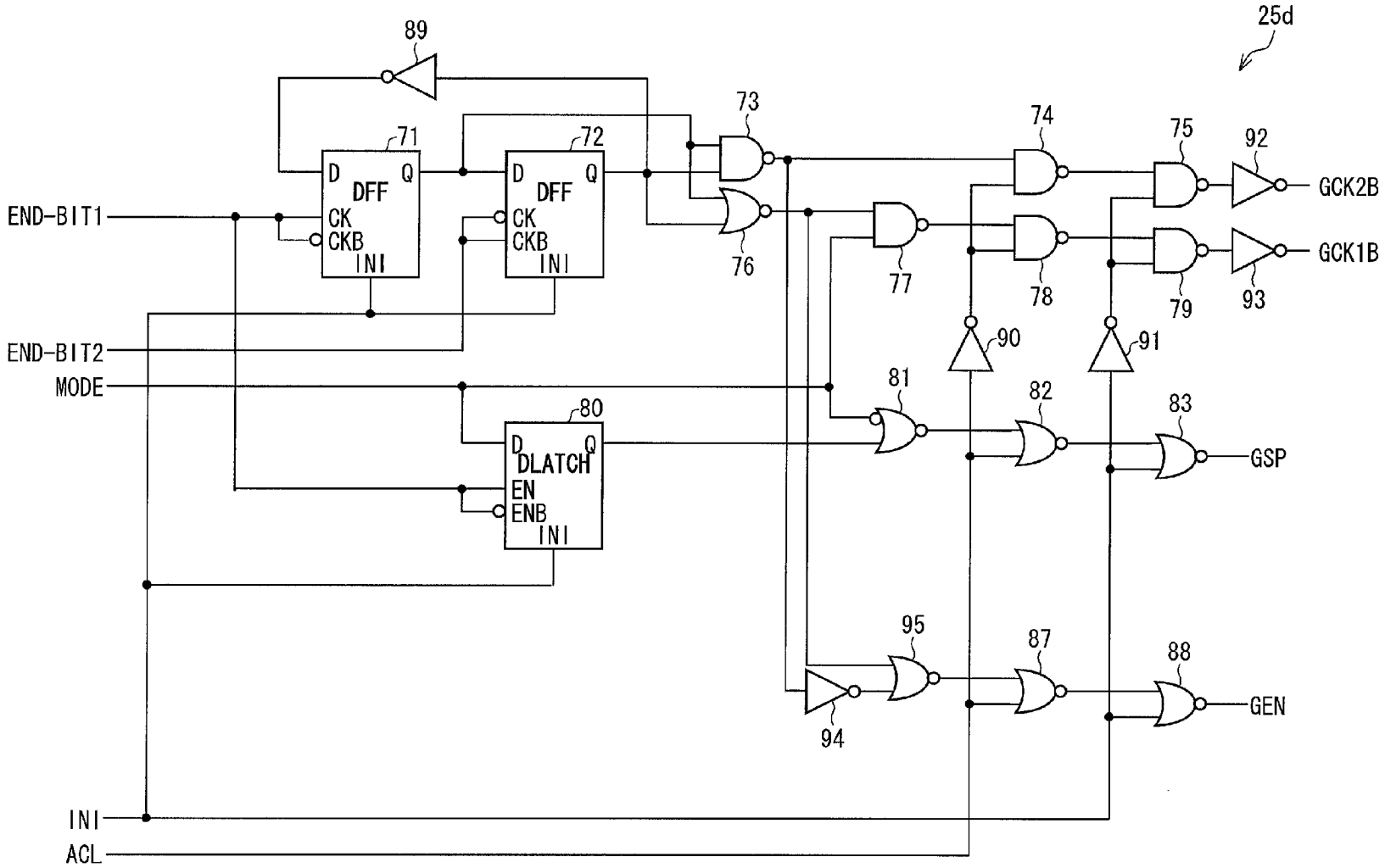
FIG. 10 is a circuit diagram illustrating a configuration of a gate driver control signal generating section.

FIG. 10 specifically illustrates an example configuration of a gate driver control signal generating section 25*d*.

A first end bit END-BIT1 is supplied to a high active clock terminal CK of a D flipflop 71 and a low active clock terminal CKB of the D flipflop 71. An output of the D flipflop 71 is supplied to a D flipflop 72. A second end bit END-BIT2 is supplied to a low active clock terminal CK of the D flipflop 72 and a high active clock terminal CKB of the D flipflop 72. An output of the D flipflop 72 is supplied to the D flipflop 71, via an inverter 89. An output of the D flipflop 71 and an output of the D flipflop 72 are supplied to a two-input NAND gate 73 and a two-input NOR gate 76, respectively. An output of the NAND gate 73 is supplied to a two-input NAND gate 74, and an all-clear signal ACL is supplied to a two-input NAND gate 74 via an inverter 90. An output of the NAND gate 74 is supplied to a two-input NAND gate 75, and an initial signal INI is supplied to a two-input NAND gate 75 via an inverter 91. An output of the NAND gate 75 is inverted by an inverter 92, and is then outputted as a gate clock GCK2B.

An output of the NOR gate 76 and a mode signal MODE are supplied to a two-input NAND gate 77. An output of the NAND gate 77 is supplied to a two-input NAND gate 78, and an all-clear signal ACL is supplied to a two-input NAND gate 78 via the inverter 90. An output of the NAND gate 78 is supplied to a two-input NAND gate 79, and an initial signal INI is supplied to a two-input NAND gate 79 via the inverter 91. An output of the NAND gate 79 is inverted by an inverter 93, and is then outputted as a gate clock GCK1B.

A mode signal MODE is supplied to a D latch 80. A first end bit END-BIT1 is supplied to each of enable terminals EN and ENB of the D latch 80. An output of the D latch 80 is supplied to a high active input of a two-input NOR gate 81, and the mode signal MODE is supplied to a low active input of the NOR gate 81. An output of the NOR gate 81 and an all-clear signal ACL are supplied to a two-input NOR gate 82. An output of the NOR gate 82 and an initial signal INI are supplied to a two-input NOR gate 83. An output of the NOR gate 83 serves as a gate start pulse GSP.

An output of the NAND gate 73 is supplied to a NOR gate 95, via an inverter 94. An output of the NOR gate 76 is also supplied to the NOR gate 95. An output of the NOR gate 95 and an all-clear signal ACL are supplied to the two-input NOR gate 87. An output of the NOR gate 87 and an initial signal INI are supplied to an NOR gate 88. An output of the NOR gate 88 serves as a gate enable signal GEN.

An initial signal INI is supplied to each initial terminal INI of the D flipflops 71 and 72 and the D latch 80. The D flipflop 71 is of a positive edge trigger type, whereas the D flipflop 72 is of a negative edge trigger type.

Figure 13:
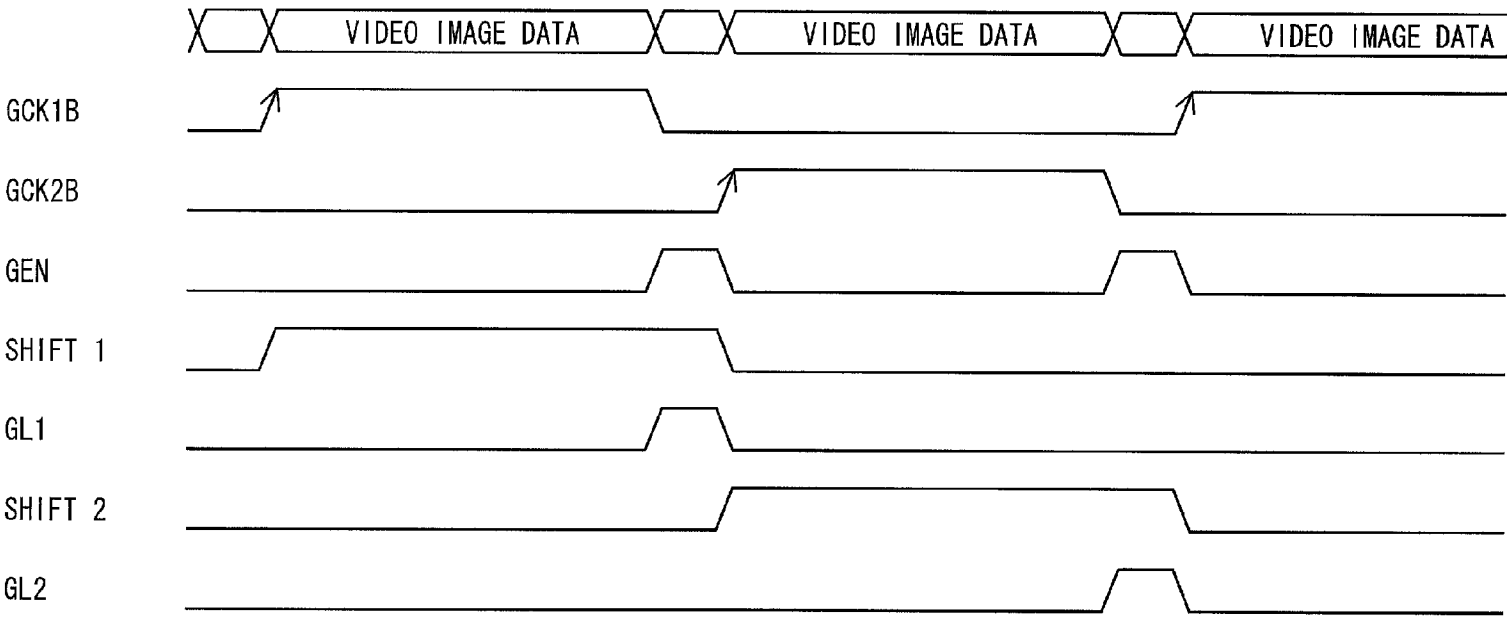
FIG. 13 is a timing chart illustrating signal waveforms of the gate driver control signal generating section.

FIG. 13 is a timing chart illustrating waveforms of gate clocks GCK1B and GCK2B, a gate enable signal GEN, and gate line outputs GL (GL1 and GL2). A shift 1 indicates a time period in which data DR, DG, and DB corresponding to a first gate line output GL1 are supplied to a source line SL whereas a shift 2 indicates a time period in which data DR, DG, and DB corresponding to a second gate line output GL2 are supplied to a source line SL. Image data is simultaneously written into a pixel memory 30 in response to a gate enable signal GEN at the end of a horizontal display period. Accordingly, even in a case where an electric potential of the source line SL is fluctuated while the data DR, DG, and DB are being sequentially supplied to the source line SL, it is hard for the storage of the image data in the pixel memory 30 to be affected.

Example 1

The following description will discuss a specific configuration of a common polarity control signal generating section 25*e*.

Figure 14:
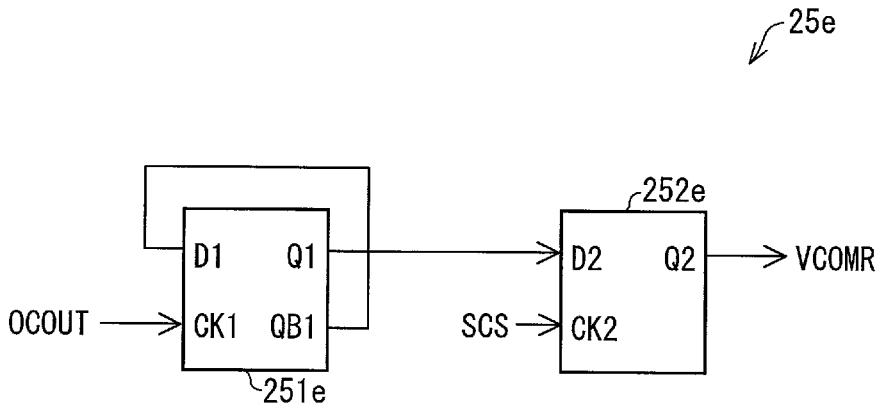
FIG. 14 is a circuit diagram illustrating a configuration of a common polarity control signal generating section of Example 1.
Figure 15:
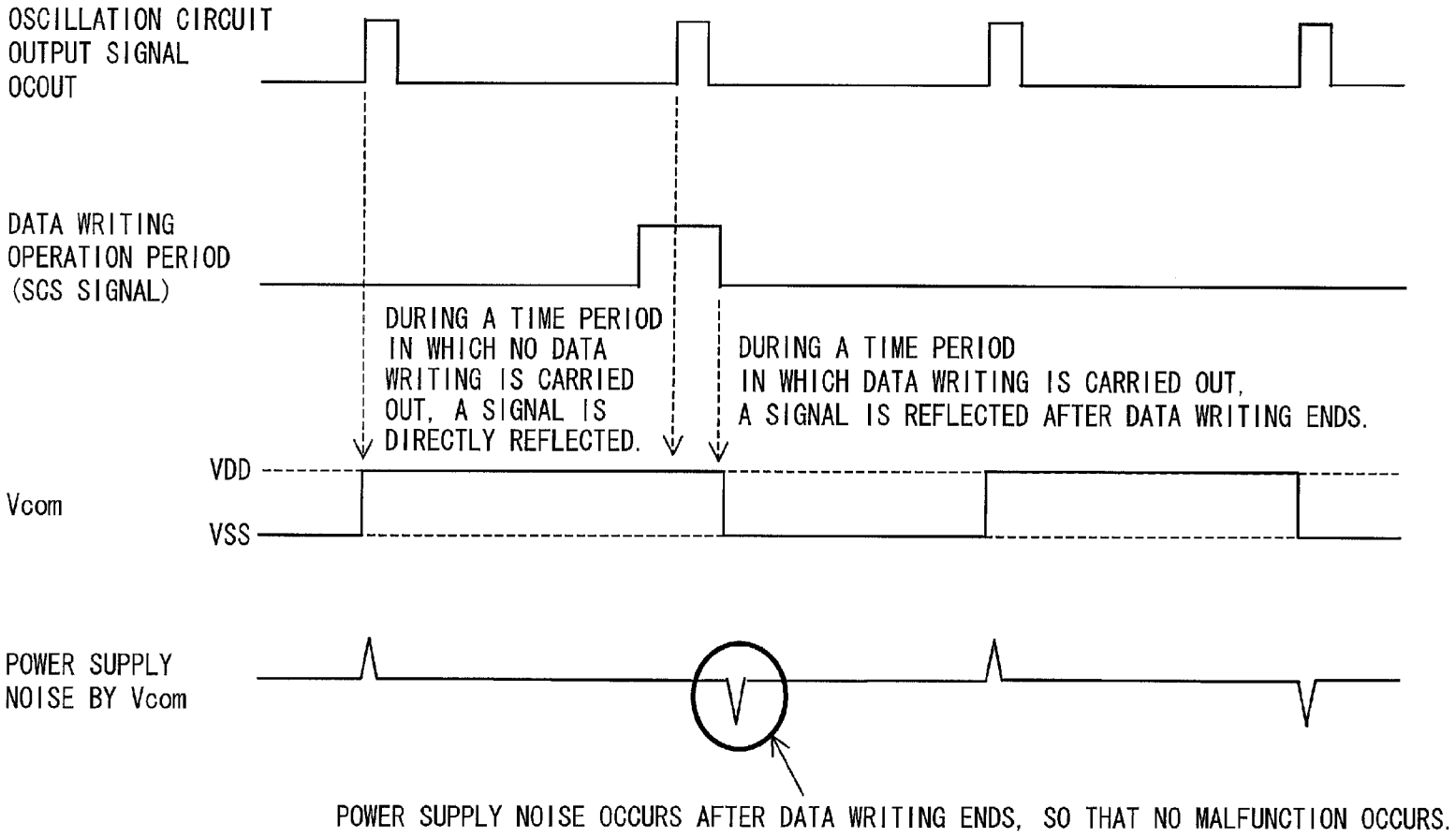
FIG. 15 is a timing chart illustrating signals which are received from and supplied to the common polarity control signal generating section.
Figure 16:
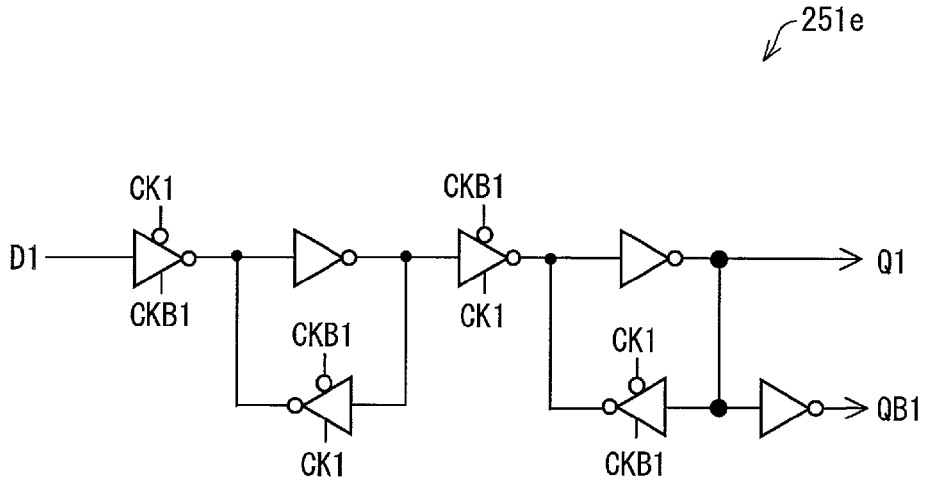
FIG. 16 is a circuit diagram illustrating a configuration of a D flipflop.
Figure 17:
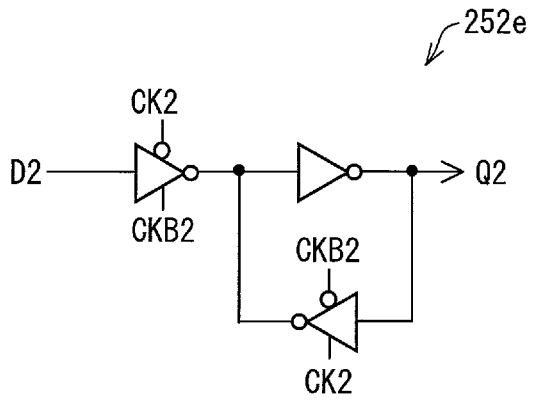
FIG. 17 is a circuit diagram illustrating a configuration of a latch circuit.

FIG. 14 is a circuit diagram illustrating a configuration of a common polarity control signal generating section 25*e* of Example 1. FIG. 15 is a timing chart illustrating signals which are received from and supplied to the common polarity control signal generating section 25*e*. The common polarity control signal generating section 25*e* includes a D flipflop 251*e* and a latch circuit 252*e*. FIG. 16 illustrates a circuit configuration of a D flipflop 251*e*. FIG. 17 illustrates a circuit configuration of a latch circuit 252*e*.

As illustrated in FIG. 16, the D flipflop 251*e* is constituted by clocked inverter circuits and inverter circuits. An input D1 is latched in synchronization with a rising edge of CK1, so that an output corresponding to the input D1 is supplied from an output terminal Q1 and an output terminal QB1.

The output QB1 of the D flipflop is connected to the input D1. The output Q1 changes in synchronization with a rising timing of an oscillation circuit output signal OCOUT which is to be supplied to the clock terminal CK1.

As illustrated in FIG. 17, the latch circuit 252*e* is constituted by a clocked inverter circuit and an inverter circuit. While a clock CK2 is in a low level, logic identical to that of an input D2 is supplied to an output terminal Q2. On the other hand, while the clock CK2 is in a high level, an input D2 is latched in synchronization with a rising edge of the clock CK2 and is then outputted from the output terminal Q2.

The output Q1 of the D flipflop 251*e* is supplied to the input D2 of the latch circuit 252*e*, and a serial chip select signal SCS is supplied as the clock CK2 of the latch circuit 252*e*. The latch circuit 252*e* latches an input D2 in synchronization with a rising edge of the serial chip select signal SCS while the serial chip select signal SCS is in a high level. As such, an output of the latch circuit 252*e* is not changed. Accordingly, even in a case where the input D2 of the latch circuit 252*e* changes while the serial chip select signal SCS is in a high level, the output Q2 of the latch circuit 252*e* will never change. A change in the input D2 reflects the output Q2 at the falling edge of the serial chip select signal SCS.

The output Q2 of the latch circuit 252*e* is supplied, as a common polarity control signal VCOMR, to the Vcom driver 26.

As has been described, the output Q1 of the D flipflop 251*e* is inverted in synchronization with the rising edge of the oscillation circuit output signal OCOUT, and then an inverted output Q1 is supplied to the input terminal D2 of the latch circuit 252*e*. Since the serial chip select signal SCS is supplied to the CK2 terminal of the latch circuit 252*e*, the output Q2 of the latch circuit 252*e* is inverted in synchronization with the rising edge of the oscillation circuit output signal OCOUT while the serial chip select signal SCS is in a low level but will never be inverted while the serial chip select signal SCS is in a high level. The output Q2 thus generated is supplied, as a common polarity control signal VCOMR, to the Vcom driver 26. A common output Vcom corresponding to a reverse timing of the common polarity control signal VCOMR is supplied from the Vcom driver 26.

That is, while the serial chip select signal SCS is in a high level, it is possible to carry out control so that no common reverse occurs (see FIG. 15). Note that the serial chip select signal SCS is (i) an enable signal based on which it is determined whether or not serial data can be received and is also (ii) a timing signal which indicates a time period in which a reverse of a polarity of a voltage of a counter electrode (common electrode) is prohibited (or permitted).

Figure 11:
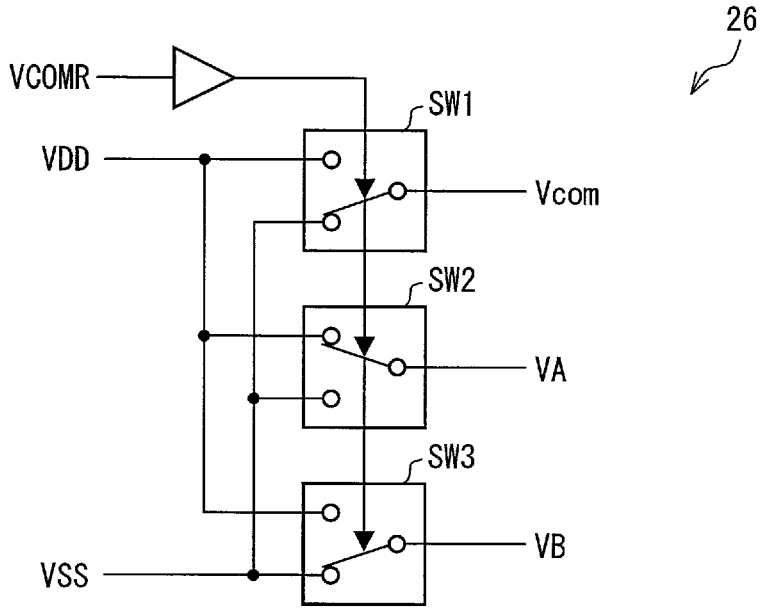
FIG. 11 is a circuit diagram illustrating a configuration of a Vcom driver.

FIG. 11 illustrates, in detail, a configuration of a Vcom driver 26.

As described above, the common polarity control signal VCOMR, generated by the common polarity control signal generating section 25*e*, is supplied, as a control signal of each of switches SW1, SW2, and SW3 corresponding to a C contact point, via a buffer. The switches SW1, SW2, and SW3 are switches which output a voltage of a common output Vcom, a black polarity output VA, and a white polarity output VB, respectively. Each time the common polarity control signal VCOMR switches between high level and low level, the switches SW1, SW2, and SW3 select power supplies so as to switch between (i) the power supplies VDD, VSS, and VDD and (ii) the power supplies VSS, VDD, and VSS, respectively.

This causes a common output Vcom illustrated in FIG. 15 to be supplied from the Vcom driver 26 to a counter electrode (common electrode) provided in the counter substrate 27.

As has been described, the display device of the present embodiment is an active matrix type display device in which image data is supplied, by a serial transmission, to a display driver while the image data is being included in serial data. The display driver extracts dummy data HDMY and the image data from the serial data in synchronization with a timing of a serial clock which is transmitted via a first wire which (a) is used during the serial transmission and (b) is different from a second wire via which the serial data is transmitted. The display driver generates, in synchronization with the timing of the serial clock, a first timing signal serving as a clock signal in synchronization with which a shift register of a data signal line driver included in the display driver is operated. The display driver generates, from a second timing signal serving as a clock signal in synchronization with which the dummy data HDMY and the shift register are operated, a third timing signal of a first horizontal period of one (1) frame period. The display driver supplies the third timing signal thus generated to the shift register of the data signal line driver. In a case where a next horizontal period exists, the display driver generates a fourth timing signal of the next horizontal period from a signal which is shifted for one (1) horizontal display period by the shift register of the data signal line driver. The display driver supplies the fourth timing signal thus generated to the shift register of the data signal line driver. The display driver generates, from the signal which is shifted for one (1) horizontal display period by the shift register of the data signal line driver, a fifth timing signal to be supplied to a shift register of a scanning signal line driver included in the display driver. The display driver writes the image data into a pixel in response to (i) the third and fourth timing signals and (ii) a scanning signal supplied from the scanning signal line driver.

With the configuration, the display driver extracts, in synchronization with the timing of the serial clock, the dummy data HDMY and the image data from the serial data which has been serially transmitted. The display driver then generates, from the dummy data HDMY, the third timing signal of the first horizontal period of one (1) frame period, and then supplies the third timing signal to the shift register of the data signal line driver. As to a second horizontal period and its succeeding horizontal periods, the display driver sequentially generates the fourth timing signal of the next horizontal period in accordance with the signal which has been shifted for one (1) horizontal display period by the shift register of the data signal line driver.

The display driver can thus generate timing signals for writing image data into a pixel by direct control which is carried out via the serial transmission.

As has been described, the display device of the present embodiment is an active matrix type display device in which image data is supplied, by a serial transmission, to a display driver while the image data is being included in serial data. The display device controls a polarity of a common electrode in response to (a) an output OCOUT of an oscillation circuit which output is transmitted via the first wire and (b) a serial chip select signal SCS.

With the configuration, polarity control (reverse) of the common electrode can be carried out separately from a transmission of the serial data. This eliminates the necessity of transmitting serial data in order to carry out a common reverse (counter reverse) in a display mode in which no data update operation is conducted. That is, since the CPU 21*d* does not need to be operated in order to carry out the common reverse, the electric power consumption will never increase. Since the serial chip select signal SCS is employed, it is possible to adjust so that a timing of the common reverse does not overlap the writing period in which the image data is written into the display panel. This makes it possible to prevent a malfunction from occurring due to an influence of power supply noise caused by the common reverse.

As such, the display device brings about an effect of providing a display device capable of preventing a malfunction and carrying out a common reverse drive without increasing electric power consumption.

Example 2

The following description will specifically discuss a configuration of a common polarity control section 25*f* of Example 2.

Figure 18:
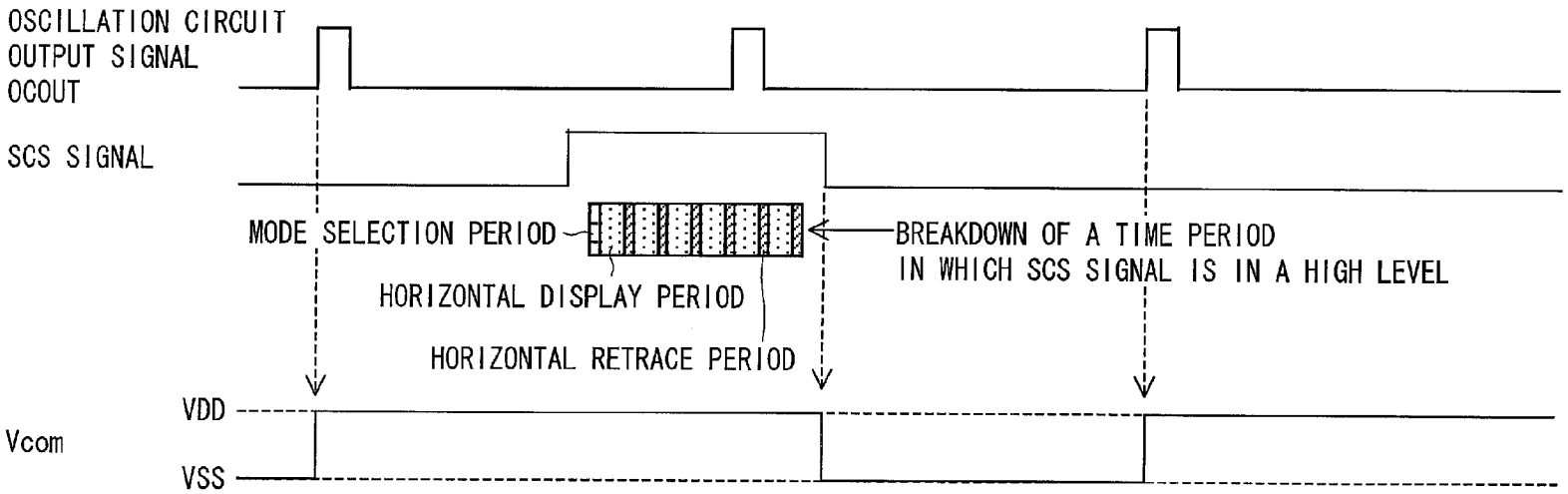
FIG. 18 is a timing chart illustrating output waveforms of the Vcom driver.

In a case where a panel resolution is small, data rewriting time is short (see FIG. 18). This causes a time period, in which an SCS signal is in a high level (an active period), to be shorter than a cycle on which a common reverse needs to be carried out. As such, as with Example 1, the above effects can be brought about by controlling a common reverse timing in response to the SCS signal.

Figure 19:
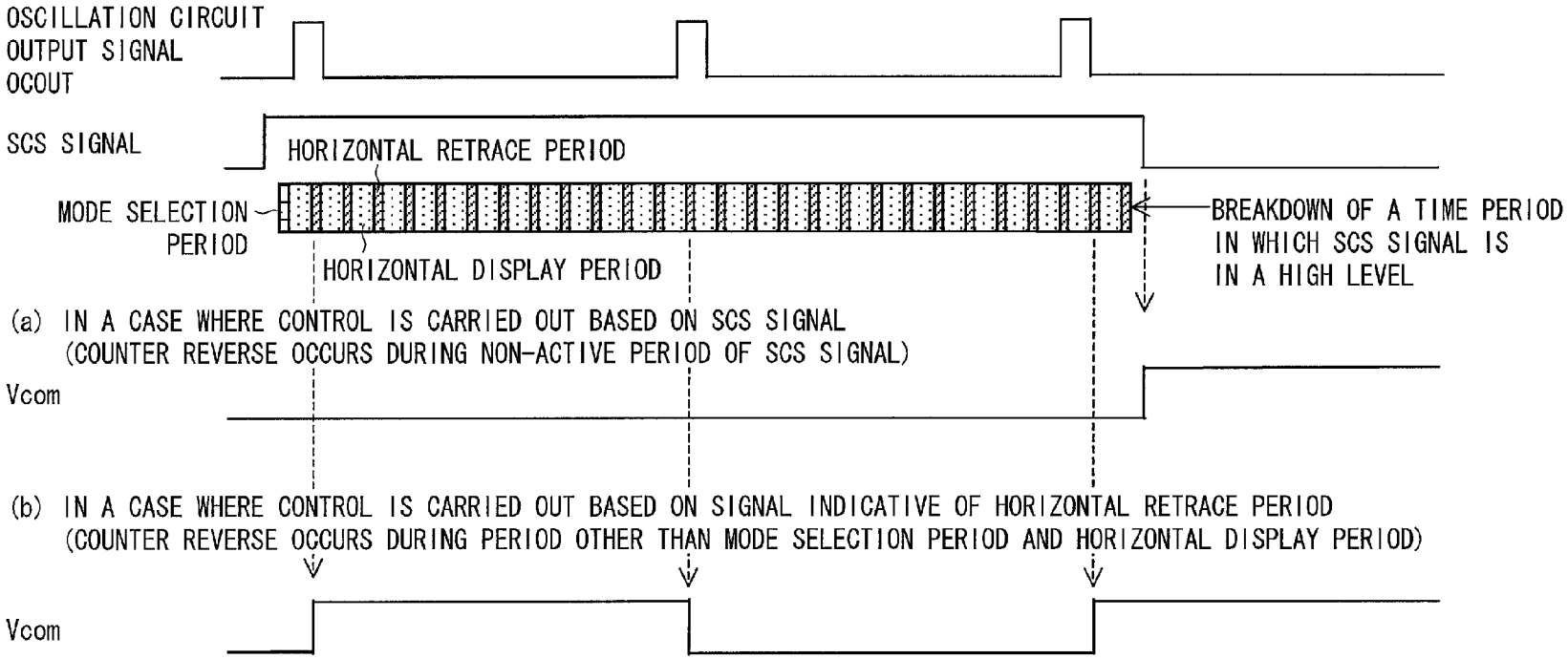
FIG. 19 is a timing chart illustrating output waveforms of the Vcom driver.

In contrast, in a case where the panel resolution is large, a data rewriting time is long (see FIG. 19). This causes a time period, in which the serial chip select signal SCS is in a high level (an active period), to be longer than a cycle on which a common reverse needs to be carried out. This causes a problem that with the configuration of Example 1, the common reverse is not properly carried out (see (a) of FIG. 19).

In order to address such a problem, the common polarity control section 25*f* of Example 2 controls a common reverse timing in response to a panel internal signal which is smaller in frequency than the serial chip select signal SCS.

Figure 20:
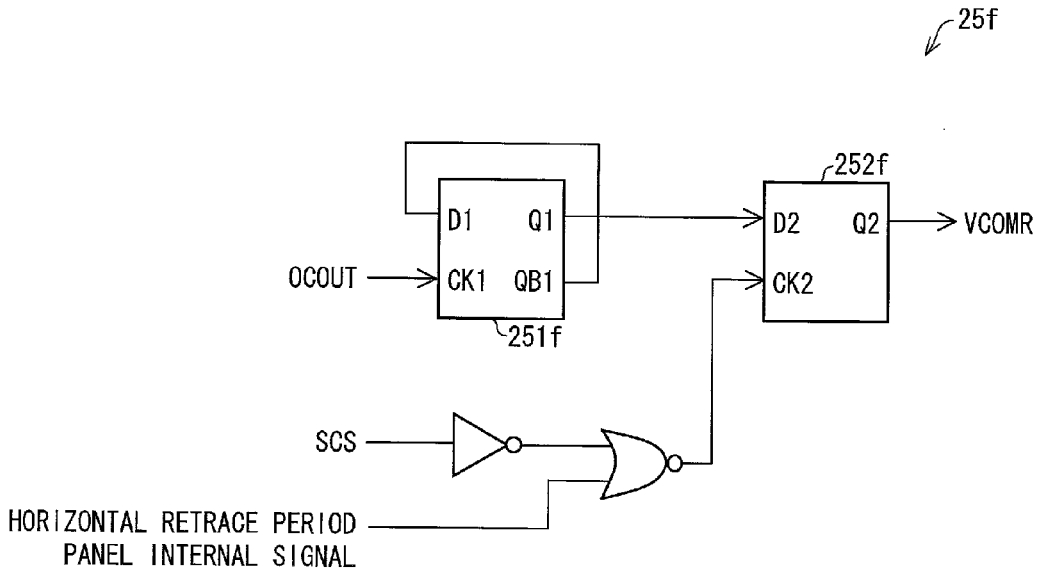
FIG. 20 is a circuit diagram illustrating a configuration of a common polarity control section of Example 2.
Figure 21:
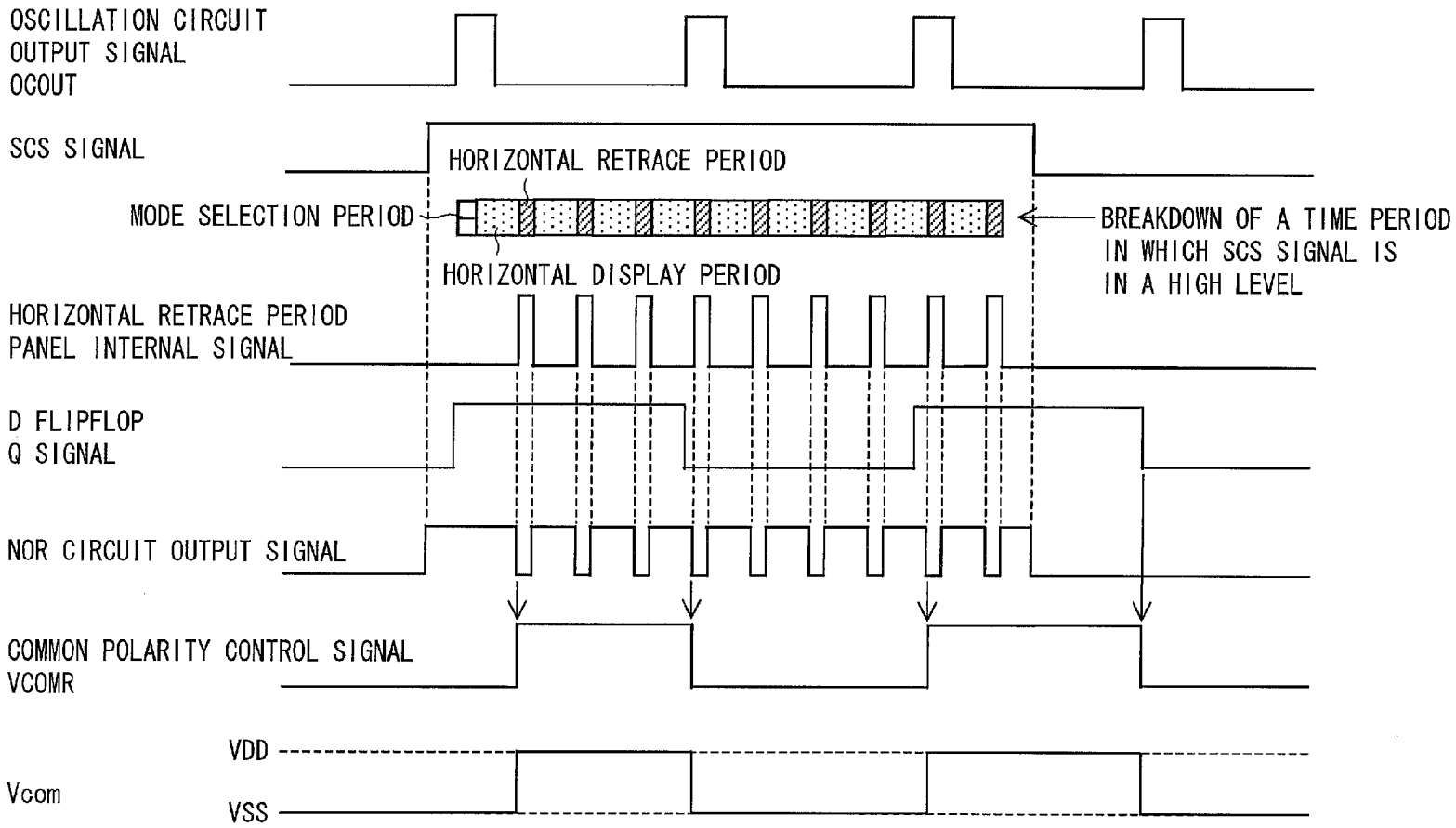
FIG. 21 is a timing chart illustrating signals which are received from and supplied to the common polarity control section illustrated in FIG. 20.

FIG. 20 is a circuit diagram illustrating a configuration of a common polarity control section 25*f* of Example 2. FIG. 21 is a timing chart illustrating signals which are received from and supplied to the common polarity control section 25*f*. The common polarity control section 25*f* includes a D flipflop 251*f* and a latch circuit 252*f*. The D flipflop 251*f* and the latch circuit 252*f* are identical, in circuit configuration, to the D flipflop 251*e* (FIG. 16) of Example 1 and the latch circuit 252*e* (FIG. 17) of Example 1, respectively.

A signal supplied to a clock terminal CK2 of the latch circuit 252*f* of the common polarity control section 25*f* of Example 2 differs from the signal supplied to the common polarity control signal generating section 25*e* of Example 1. The following description will mainly discuss a difference between the common polarity control section 25*f* of Example 2 and the common polarity control signal generating section 25*e* of Example 1.

According to the common polarity control section 25*f*, as illustrated in FIG. 20, a serial chip select signal SCS is supplied to an NOR circuit via an inverter circuit. A panel internal signal which indicates a horizontal retrace period is also supplied to the NOR circuit. An output of the NOR circuit is supplied to the clock terminal CK2 of the latch circuit 252*f*.

The following description will discuss the panel internal signal, which indicates the horizontal retrace period. A time period in which the serial chip select signal SCS is in a high level (twSCSH; an active period) contains a mode selection period, a horizontal display period, and a horizontal retrace period (see FIG. 2). The panel internal signal is a signal which indicates timings of start and end of the horizontal retrace period in an active period of the serial chip select signal SCS (see FIG. 21).

In a case where (i) the panel internal signal and (ii) a signal which is obtained by inverting the serial chip select signal SCS are supplied to the NOR circuit, an NOR circuit output signal is supplied from the NOR circuit (see FIG. 21). In a case where the NOR circuit output signal is supplied to the clock terminal CK2 of the latch circuit 252*f*, a common polarity control signal VCOMR is outputted from the latch circuit 252*f* (see FIG. 21). The common polarity control signal VCOMR is supplied to the Vcom driver 26 (see FIGS. 1 and 11) so that a common output Vcom is outputted from the Vcom driver 26.

With the configuration, it is possible (i) to control the common reverse timing in response to a timing signal corresponding to, out of a time period in which the serial chip select signal SCS is in a high level, a time period in which a malfunction does not occur due to noise of the common reverse (according to the example, the panel internal signal which indicates the horizontal retrace period) and (ii) to control the common reverse during a time period in which the serial chip select signal SCS is in a low level without carrying out a timing control as with the conventional display device.

Since the panel internal signal is employed, it is possible to make shorter a frequency of a signal for carrying out a common reverse timing control than a common reverse cycle. This makes it possible to surely conduct the common reverse operation.

The panel internal signal, which indicates the horizontal retrace period, is a timing signal (reversible timing signal) which allows a polarity of a voltage of a common electrode to be reversed even during a time period in which reverse of the polarity of the voltage is prohibited.

Note that, during the horizontal retrace period, neither an operation in which data is fetched nor an operation in which flag is fetched at a high frequency is conducted. As such, even in a case noise occurs, it is possible to surely prevent a malfunction from occurring due to such noise.

With the configuration, it is possible (i) to bring about an effect similar to that of Example 1 and (ii) to surely carry out a common reverse.

Example 3

The following description will discuss a specific configuration of a common polarity control section 25*g* of Example 3.

The common polarity control section 25*g* of Example 3 is configured such that a timing signal which indicates a horizontal retrace period of the common polarity control section 25*f* of Example 2 is generated by a CPU 21*d* and is supplied to the common polarity control section 25*g*.

Figure 22:
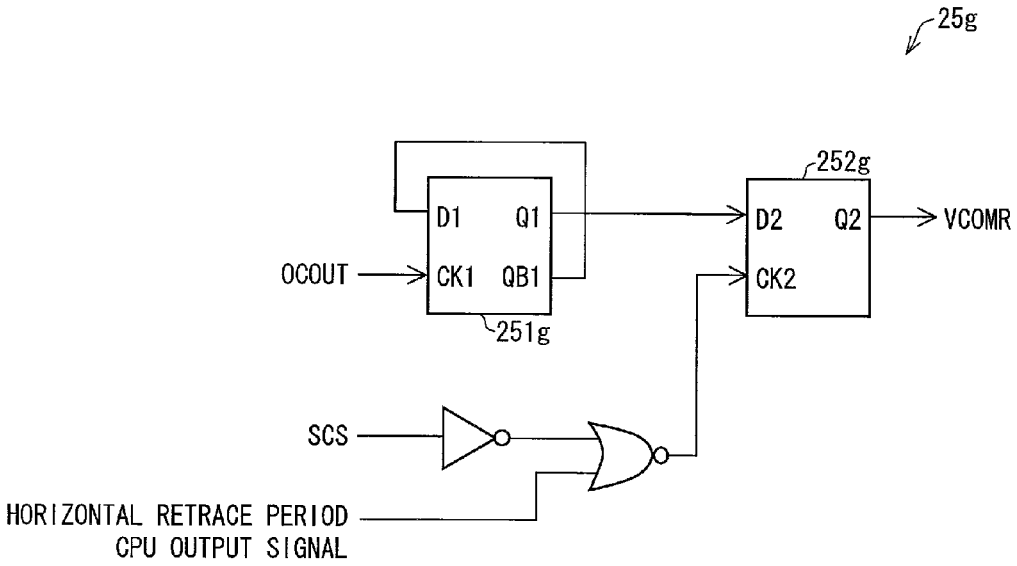
FIG. 22 is a circuit diagram illustrating a configuration of a common polarity control section of Example 3.
Figure 23:
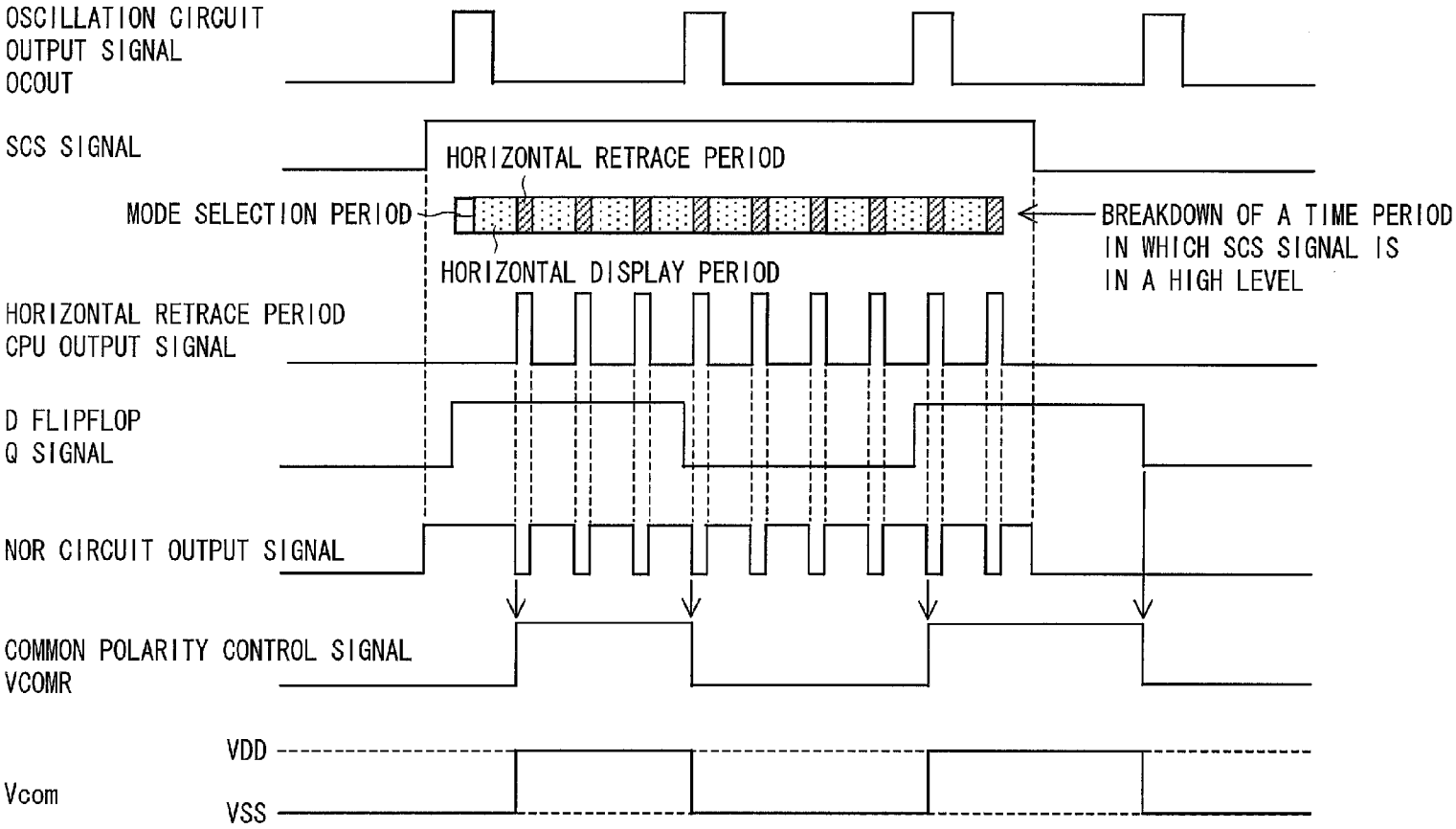
FIG. 23 is a timing chart illustrating signals which are received from and supplied to the common polarity control section illustrated in FIG. 22.

FIG. 22 is a circuit diagram illustrating a configuration of a common polarity control section 25*g* of Example 3. FIG. 23 is a timing chart illustrating signals which are received from and supplied to the common polarity control section 25*g*. The common polarity control section 25*g* includes a D flipflop 251*g* and a latch circuit 252*g*. The D flipflop 251*g* and the latch circuit 252*g* are identical in circuit configuration to the D flipflop 251*e* (FIG. 16) of Example 1 and the latch circuit 252*e* (FIG. 17) of Example 1, respectively. Moreover, the common polarity control section 25*g* is identical in configuration to the common polarity control section 25*f* of Example 2.

A signal supplied to a clock terminal CK2 of the latch circuit 252*g* of the common polarity control section 25*g* of Example 3 differs from the signal supplied to the clock terminal CK2 of the latch circuit 252*f* of the common polarity control section 25*f* of Example 2. The following description will mainly discuss a difference between the common polarity control signal generating section 25*g* of Example 3 and the common polarity control section 25*f* of Example 2.

According to the common polarity control section 25*g*, as illustrated in FIG. 22, a serial chip select signal SCS is supplied to an NOR circuit via an inverter circuit. A CPU output signal which indicates a horizontal retrace period is also supplied to the NOR circuit. An output of the NOR circuit is supplied to the clock terminal CK2 of the latch circuit 252*g*.

With the configuration, it is possible to (i) bring about an effect similar to that of Example 2 and (ii) bring about an effect of carrying out control easily. This is because the CPU 21*d* can directly specify a time period in which no data transmission is carried out during a time period in which the serial chip select signal SCS is in a high level.

Modification

According to the configurations, the dummy data HDMY and NDMY and the flag D2 are provided at the head of one (1) frame. However, the configuration of the present invention is not limited to this. Alternatively, it is possible to provide each flag at an arbitrary timing when an instruction to the timing generator 25 is intended to be carried out.

According to the configurations, the control carried out by use of the flag is subjected to only the ACL operation but is not limited to this. Alternatively, another function can be added. Another configuration can be alternatively employed in which writing of data is carried out by specifying a gate line and a source line.

According to the configurations, the serial chip select signal SCS is used to generate various types of timing signals but is not limited to this. Alternatively, a configuration can be employed in which, for example, the serial/parallel conversion section 25*a* is always in a state where receiving of the serial data is enable.

According to the configurations, the active area 22 includes the pixel memory 30 but is not limited to this. Alternatively, The present invention is also applicable to a display device including an active area having no pixel memory.

Figure 24:
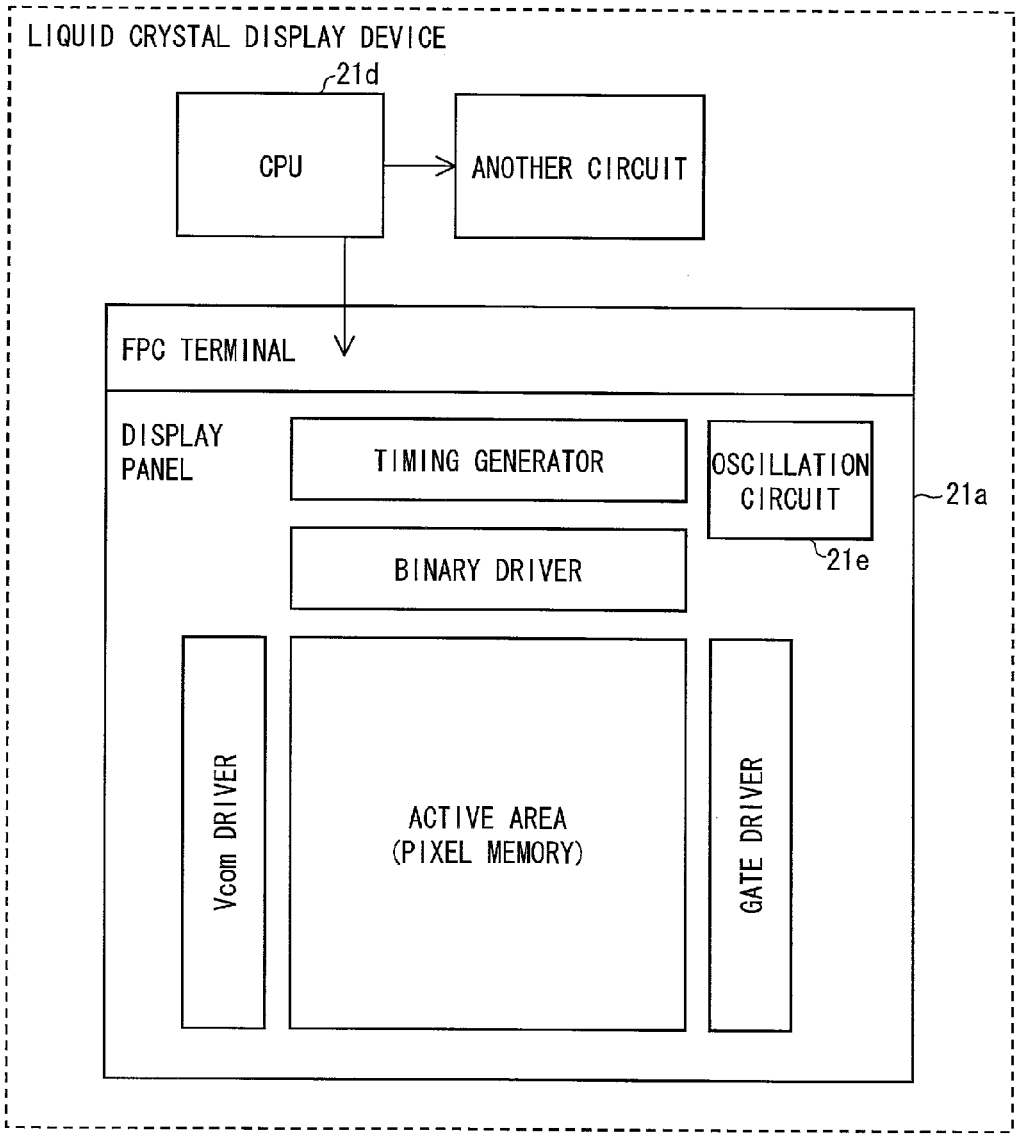
FIG. 24 is a view schematically illustrating a configuration of a liquid crystal display device in which an oscillation circuit is provided in a display panel.
Figure 25:
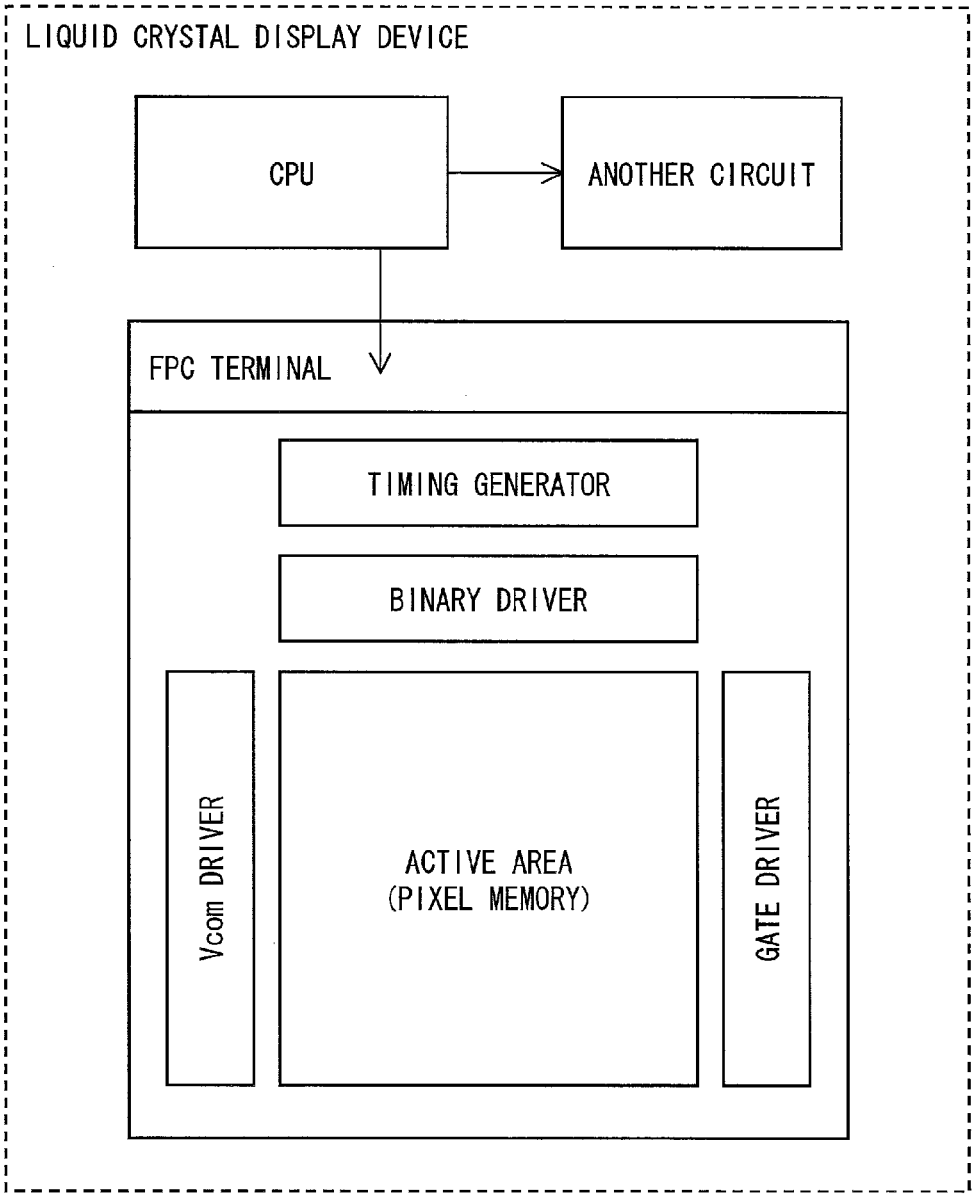
FIG. 25 is a view schematically illustrating a configuration of a conventional display device.
Figure 26:
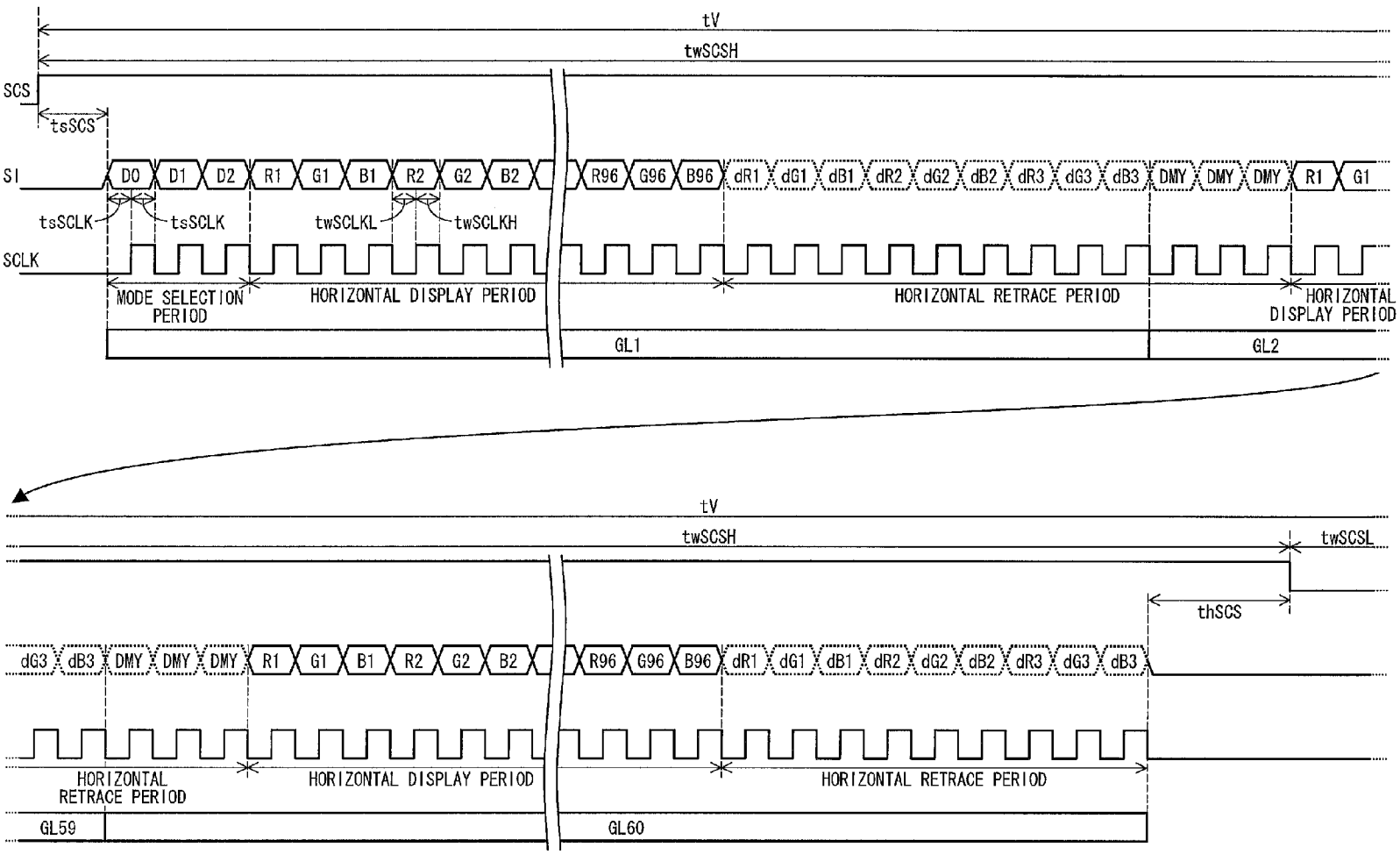
FIG. 26 is a timing chart illustrating waveforms of respective signals supplied to the display device illustrated in FIG. 25.
Figure 27:
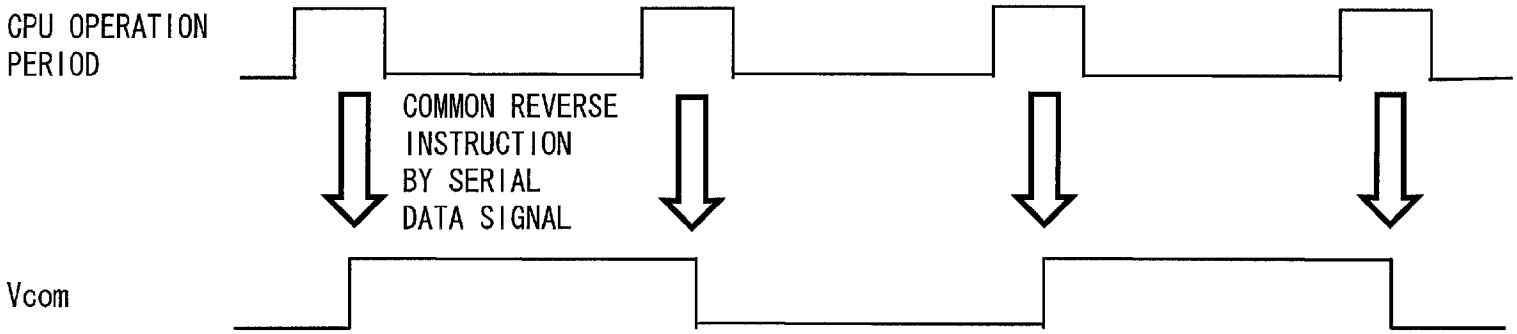
FIG. 27 is a timing chart illustrating output waveforms of a Vcom driver of the display device illustrated in FIG. 25.
Figure 28:
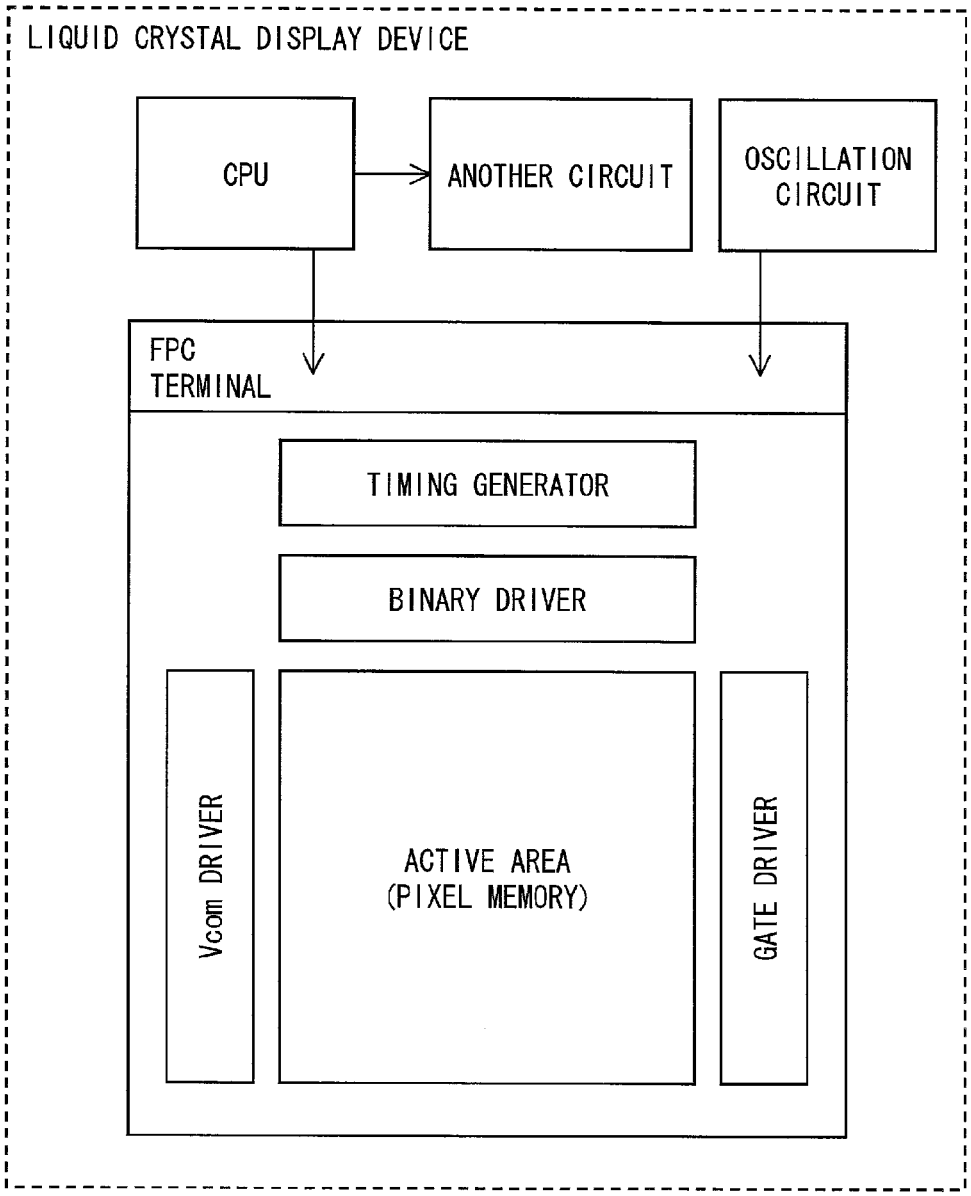
FIG. 28 is a view schematically illustrating another configuration of a conventional display device.
Figure 29:
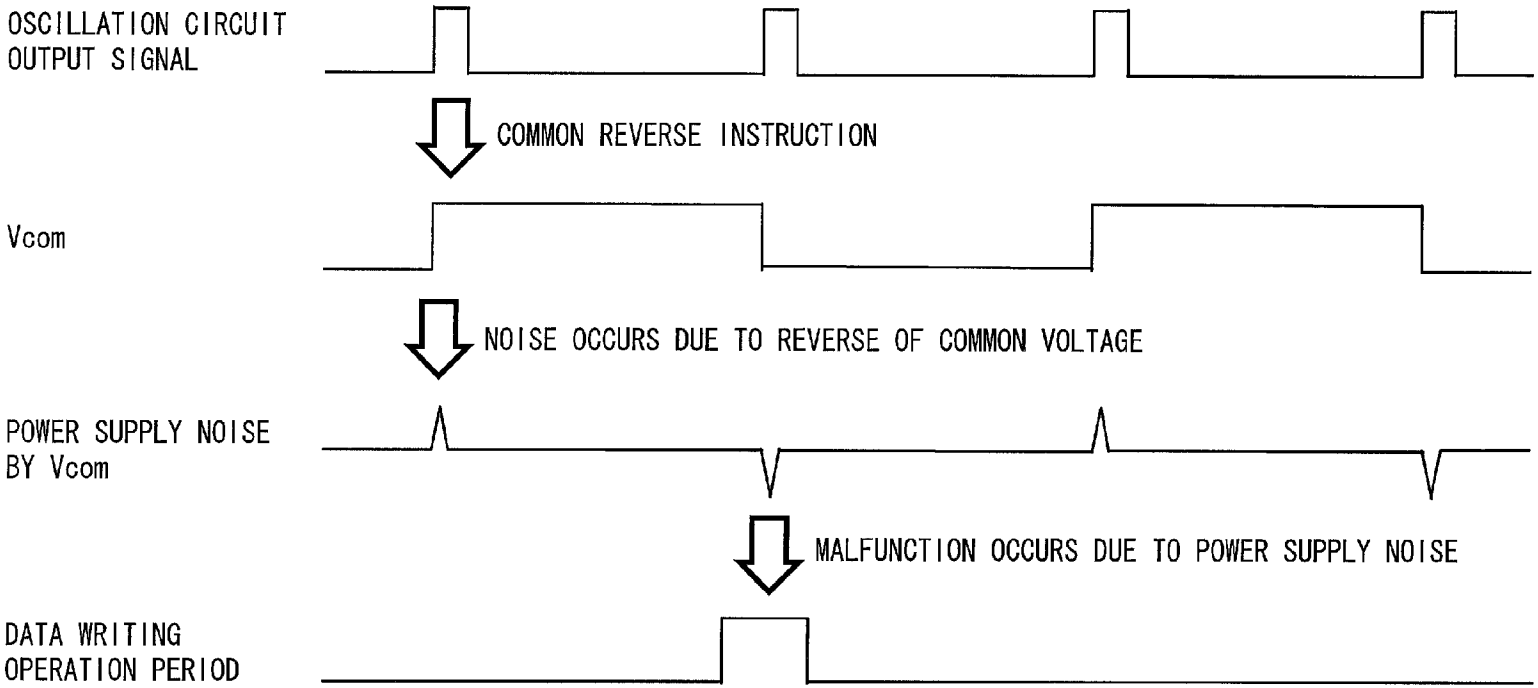
FIG. 29 is a timing chart illustrating output waveforms of a Vcom driver of the display device illustrated in FIG. 28.

The oscillation circuit 21*e* is not limited to the configuration in which the oscillation circuit 21*e* is provided outside of the display panel 21*a* (see FIG. 3). Alternatively, the oscillation circuit 21*e* can be provided inside of the display panel 21*a*. FIG. 24 is a view schematically illustrating a configuration of a liquid crystal display device 21 in which an oscillation circuit 21*e* is provided in a display panel 21*a*. According to the configuration illustrated in FIG. 24, an output signal OCOUT of the oscillation circuit 21*e* is generated in the display panel 21*a*. The display driver controls a polarity of a common electrode in response to (i) an oscillation circuit output signal OCOUT which (a) is generated in the display panel 21*a* and (b) is transmitted via a first wire different from a second wire used during the serial transmission and (ii) a serial chip select signal SCS. Note here that the first wire is a wire provided in the display panel 21*a*.

As illustrated in FIG. 24, the display device of the present invention can be configured to be an active matrix type display device including:

a display driver to which image data is supplied, by a serial transmission, while the image data is being included in serial data, the display driver (a) carrying out display in accordance with the serial data, (b) supplying a voltage, of a common electrode, whose polarity is determined in accordance with (i) a timing signal, having a certain cycle, which is generated in the display panel and (ii) at least one reverse prohibiting timing signal which indicates a time period in which a reverse of a polarity of a voltage of a common electrode is prohibited or at least one reverse permitting timing signal which indicates a time period in which a reverse of a polarity of a voltage of a common electrode is permitted, and (c) controlling a reverse timing of the polarity of the voltage of the common electrode in accordance with the timing signal having the certain cycle and the reverse prohibiting timing signal or the reverse permitting timing signal.

According to the configurations, the output of the external oscillation circuit 21*e* is used. Note, however, that the configuration of the present invention is not limited to this, provided that a timing signal of a certain cycle is used. Note, however, that in a case where a frequency is much faster than that of the counter reverse cycle, some signals cannot be used because a size of a circuit such as a division circuit may be increased.

The timing signal of the certain cycle is not limited to the output signal OCOUT of the external oscillation circuit 21*e*. Examples of the timing signal of the certain cycle encompass (i) a system clock of a CPU, (ii) a signal which is used in another circuit different from a display device in a set of an electronic device (a circuit region other than the display device), and (iii) a signal which is generated in accordance with the signal used in the another circuit.

As described above, the oscillation circuit 21*e* is provided outside for the counter reverse of the display device. Note, however, that many circuits other than the display device are provided in a set of electronic device. For example, a circuit section which controls a clock function generally (i) requires a signal waveform which has a certain cycle and is provided for counting time and (ii) generates, for the clock function, a clock waveform by use of an oscillation circuit etc. The clock waveform thus generated may be used as it is. Alternatively, the clock waveform can be processed in the circuit as needed and be used as a timing signal of a certain cycle. In a case of a configuration in which a signal of a certain cycle which signal has been generated not for a counter reverse but for another function is used as it is for the counter reverse, it is possible to bring about an effect of eliminating the necessity of providing oscillation circuit for the display device.

SUMMARY

In order to attain the object, a display device of the present invention is an active matrix type display device including: a display driver to which image data is supplied, by a serial transmission, while the image data is being included in serial data, the display driver (a) carrying out display in accordance with the serial data, (b) supplying a voltage, of a common electrode, whose polarity is determined in accordance with (i) a timing signal, having a certain cycle, which is transmitted via a first wire which is different from a second wire used during the serial transmission and (ii) at least one reverse timing signal which indicates a time period in which a reverse of a polarity of a voltage of a common electrode is prohibited or permitted, and (c) controlling a reverse timing of the polarity of the voltage of the common electrode in accordance with the timing signal having the certain cycle and the reverse timing signal.

With the configuration, polarity control (reverse) of the common electrode can be carried out separately from a transmission of the serial data. This eliminates the necessity of transmitting serial data in order to carry out a common reverse (counter reverse) in a display mode in which no data update operation is conducted. That is, since the CPU does not need to be operated in order to carry out the common reverse, the electric power consumption will never increase.

Since the reverse timing signal is employed, it is possible to adjust so that a timing of the common reverse does not overlap the writing period in which the image data is written into the display panel. This makes it possible to prevent a malfunction from occurring due to an influence of power supply noise caused by the common reverse.

As such, it is possible to provide a display device capable of preventing a malfunction and carrying out a common reverse drive without increasing electric power consumption.

The display device can be configured such that the display driver controls the reverse timing so that the polarity of the voltage of the common electrode is not reversed during a writing period of the serial data.

The display device can be configured such that a pixel includes a pixel memory which stores the image data supplied from the display driver; and the image data is stored in the pixel memory while the image data, to be stored in the pixel memory, is being included in the serial data.

The display device can be configured such that the reverse timing signal is a serial chip select signal which is transmitted via the second wire; and the polarity of the voltage of the common electrode is determined in accordance with (i) the timing signal having the certain cycle and (ii) the serial chip select signal.

The display device can be configured such that a timing generator, which (a) is included in the display driver and (b) generates a display timing signal, includes a common polarity control signal generating section which generates a common polarity control signal for controlling the polarity of the voltage of the common electrode; and the common polarity control signal generating section generates the common polarity control signal in accordance with (i) the timing signal having the certain cycle and (ii) the serial chip select signal.

The display device can be configured such that the timing signal having the certain cycle is an output signal of an oscillation circuit.

The display device can be configured such that the reverse timing signal is made up of (a) a serial chip select signal which is transmitted via the second wire and (b) a reversible timing signal capable of reversing the polarity of the voltage of the common electrode even during a time period in which a reverse of the polarity of the voltage of the common electrode is prohibited; and the polarity of the voltage of the common electrode is determined in accordance with the timing signal having the certain cycle, the serial chip select signal, and the reversible timing signal.

The display device can be configured such that a timing generator, which (a) is included in the display driver and (b) generates a display timing signal, includes a common polarity control signal generating section which generates a common polarity control signal for controlling the polarity of the voltage of the common electrode; and the common polarity control signal generating section generates the common polarity control signal in accordance with the timing signal having the certain cycle, the serial chip select signal, and the reversible timing signal.

The display device can be configured such that the timing signal having the certain cycle is an output signal of an oscillation circuit.

The display device can be configured such that the reversible timing signal is a retrace timing signal indicative of a horizontal retrace period of the image data.

The display device can be configured such that the reversible timing signal is generated in a display panel or a CPU.

The display device can be configured such that an analog switch in the pixel is configured by a CMOS circuit.

The display device can be configured such that the oscillation circuit is provided in a display panel.

The display device can be configured such that the display driver is monolithically integrated with a display panel.

An electronic device of the present invention includes, as a display, the display device.

The present invention is not limited to the description of each of the embodiments above, but may be altered by a skilled person in the art within the scope of the claims. An embodiment derived from a proper combination of technical means disclosed in different embodiments is encompassed in the technical scope of the present invention.

INDUSTRIAL APPLICABILITY

The present invention is applicable to an electronic device such as a mobile phone, a watch having a GPS function, or a microwave oven.

REFERENCE SIGNS LIST

21: Liquid crystal display device (display device)
21*d*: CPU
21*e*: Oscillation circuit
23: Binary driver
23*a*: Shift register (shift register of data signal line driver)
23*b*: Data latch
24: Gate driver
24*a*: Shift register (shift register of scanning signal line driver)
25: Timing generator
25*e*, 25*f*, 25*g*: Common polarity control signal generating section
26: Vcom driver
30: Pixel memory
D2: Flag
I/F BUS: Serial interface bus
SI: Serial data
SCLK: Serial clock
SCS: Serial chip select signal (reverse timing signal)
SL: Source line (data signal line)
OCOUT: Oscillation circuit output signal
VCOMR: Common polarity control signal
Vcom: Common output (voltage of common electrode)

The invention claimed is:

1. An active-matrix display device comprising:

a display driver to which image data is supplied by a serial transmission while the image data is being included in serial data, wherein the display driver (a) performs display in accordance with the serial data, (b) supplies a voltage, of a common electrode, whose polarity is determined in accordance with (i) a timing signal, having a certain cycle, which is transmitted via a first wire which is different from a second wire used during the serial transmission and (ii) at least one reverse timing signal that indicates a time period in which a reverse of a polarity of a voltage of a common electrode is prohibited or permitted, and (c) controls a reverse timing of the polarity of the voltage of the common electrode in accordance with the timing signal having the certain cycle and the reverse timing signal, the reverse timing signal includes (a) a serial chip select signal that is transmitted via the second wire and (b) a reversible timing signal capable of reversing the polarity of the voltage of the common electrode even during a time period in which a reverse of the polarity of the voltage of the common electrode is prohibited, and the polarity of the voltage of the common electrode is determined in accordance with the timing signal having the certain cycle, the serial chip select signal, and the reversible timing signal such that (i) the reverse timing of the polarity of the voltage of the common electrode is controlled in response to a timing signal corresponding to, out of a time period in which the serial chip select signal is at a high level, a time period in which a malfunction does not occur due to noise of a common reverse and (ii) the reverse timing of the polarity of the voltage of the common electrode is controlled in accordance with the timing signal having the certain cycle and the reverse timing signal during a time period in which the serial chip select signal is at a low level.

2. The display device as set forth in claim 1, wherein:

a timing generator, which (a) is included in the display driver and (b) generates a display timing signal, includes a common polarity control signal generating section which generates a common polarity control signal for controlling the polarity of the voltage of the common electrode; and the common polarity control signal generating section generates the common polarity control signal in accordance with the timing signal having the certain cycle, the serial chip select signal, and the reversible timing signal.

3. The display device as set forth in claim 1, wherein the timing signal having the certain cycle is an output signal of an oscillation circuit.

4. The display device as set forth in claim 1, wherein the reversible timing signal is a retrace timing signal indicative of a horizontal retrace period of the image data.

5. The display device as set forth in claim 1, wherein the reversible timing signal is generated in a display panel or a CPU.

* * * * *